US011014396B1

(12) United States Patent
Buechel et al.

(10) Patent No.: US 11,014,396 B1
(45) Date of Patent: May 25, 2021

(54) BOOKLET AND METHOD OF FORMING SAME

(71) Applicant: The Segerdahl Corp., Wheeling, IL (US)

(72) Inventors: Steven Buechel, Gurnee, IL (US); Randy Van Oost, Orland Park, IL (US)

(73) Assignee: THE SEGERDAHL CORP., Wheeling, IL (US)

( * ) Notice: Subject to any disclaimer, the term of this patent is extended or adjusted under 35 U.S.C. 154(b) by 0 days.

(21) Appl. No.: 16/986,555

(22) Filed: Aug. 6, 2020

Related U.S. Application Data

(60) Provisional application No. 63/051,831, filed on Jul. 14, 2020.

(51) Int. Cl.

| | |
|---|---|
| ***B42D 1/04*** | (2006.01) |
| ***B42C 3/00*** | (2006.01) |
| ***B42D 1/00*** | (2006.01) |
| ***B42C 19/02*** | (2006.01) |

(52) U.S. Cl.
CPC ..... *B42D 1/04* (2013.01); *B42C 3/00* (2013.01); *B42C 19/02* (2013.01); *B42D 1/004* (2013.01); *B42D 1/008* (2013.01)

(58) Field of Classification Search
CPC ..... B42D 1/04; B42D 1/008; B42D 1/004; B42C 3/00; B42C 19/02
USPC ..... 40/725, 726; 281/5, 15.1
See application file for complete search history.

(56) References Cited

U.S. PATENT DOCUMENTS

| | | | | |
|---|---|---|---|---|
| 864,984 | A | 9/1907 | McPhee | |
| 958,582 | A | 5/1910 | Bodine | |
| 1,415,429 | A | 5/1922 | Cueny | |
| 1,431,714 | A | 10/1922 | Wilking | |
| 1,603,362 | A | 10/1926 | Stewart | |
| 2,105,696 | A | 1/1938 | Lewis | |
| 2,177,071 | A | 10/1939 | Klein et al. | |
| 2,253,858 | A | 8/1941 | Lucas et al. | |
| 2,287,365 | A | 6/1942 | Widder et al. | |
| 2,595,972 | A | 5/1952 | Naurison | |
| 3,008,248 | A | 11/1961 | Steinthal | |
| 4,150,844 | A | 4/1979 | Yoshizawa | |
| 4,441,270 | A | 4/1984 | Crowell et al. | |
| 4,706,396 | A | 11/1987 | Nomura | |
| 4,885,859 | A * | 12/1989 | Gasser | B42D 15/04 40/539 |
| 5,437,476 | A | 8/1995 | Hutchinson | |

(Continued)

OTHER PUBLICATIONS

Office Action from U.S. Appl. No. 16/986,561 dated Dec. 23, 2020, 8 pages.

*Primary Examiner* — Justin V Lewis

(74) *Attorney, Agent, or Firm* — Klintworth & Rozenblat IP LLP

(57) ABSTRACT

A booklet includes a cover including an integrally formed front cover sheet and a rear cover sheet connected by a hinge fold around which the front cover sheet is pivoted relative to the rear cover between a closed position and an open position, and at least first and second leaves therein. Each leaf includes at least one integrally formed leaf sheet and spine sheet connected together at a hinge fold. Upon pivoting the front cover sheet between a closed position and an open position, the interior leaves move relative to the front cover sheet and a step display tab area on each interior leaf is progressively revealed. A method of forming the booklet is also disclosed.

23 Claims, 16 Drawing Sheets

(56) References Cited

U.S. PATENT DOCUMENTS

| | | | | |
|---|---|---|---|---|
| 5,630,626 | A | 5/1997 | Harper | |
| 6,246,461 | B1 | 6/2001 | Hinsberg | |
| 9,415,624 | B1 | 8/2016 | Bedinghaus | |
| 2004/0082259 | A1* | 4/2004 | Yum ..... | B42D 15/042 446/151 |
| 2012/0112449 | A1 | 5/2012 | Engel et al. | |

* cited by examiner

BOOKLET AND METHOD OF FORMING SAME

CROSS-REFERENCE TO RELATED APPLICATION

This application claims the domestic benefit of U.S. Provisional Application Ser. No. 63/051,831, filed on Jul. 14, 2020, the contents of which are hereby incorporated by reference in its entirety.

FIELD OF THE DISCLOSURE

The present disclosure relates to a booklet used for various purposes, including but not limited to, advertising, fiction material, nonfiction material, artwork or other written materials.

BACKGROUND

U.S. Pat. No. 9,415,624 discloses a moving step article and its method of manufacture. The moving step article has front and rear cover sheets pivotally connected to each other, and a plurality of interior leaves. Upon pivoting the front cover sheet between a closed position and an open position, the interior leaves move relative to the front cover sheet and a step display tab area on each interior leaf is progressively revealed.

SUMMARY

A booklet in accordance with example embodiments is provided for various purposes, including but not limited to, advertising, fiction material, nonfiction material, artwork or other written materials.

In an embodiment, a booklet includes a cover including a front cover sheet and a rear cover sheet connected by a hinge fold around which the front cover sheet is pivoted relative to the rear cover between a closed position and an open position; and first and second leaves provided therein. Each leaf includes an integrally formed first leaf sheet, spine sheet and second leaf sheet. Each first leaf sheet and the respective spine sheet connected together at a first hinge fold, each second leaf sheet and the respective spine sheet connected together at a second hinge fold. The first leaf is secured directly to the front cover sheet and the second leaf is nested within the first leaf. The spine sheet of the first leaf has a front surface secured directly to a rear surface of the front cover sheet with the first hinge fold of the first leaf proximate to the hinge fold of the cover. The spine sheet of the second leaf has a front surface secured directly to a rear surface of the spine sheet of the first leaf with the first hinge fold of the second leaf proximate to the first hinge fold of the first leaf. A first leaf offset dimension is defined between the hinge fold of the cover and the first hinge fold of the second leaf, a second leaf offset dimension is defined between the hinge fold of the cover and the second hinge fold of the second leaf, and a third leaf offset dimension is defined between the hinge fold of the cover and the second hinge fold of the first leaf. The first leaf offset dimension being less than the second offset dimension, the second leaf offset dimension being less than the third leaf offset dimension.

In an embodiment, a method of forming a booklet includes positioning a first ribbon on a third ribbon and securing the first ribbon on the third ribbon, positioning a second ribbon on the first ribbon and securing the second ribbon on the first ribbon, folding the second ribbon along a first fold line of the second ribbon in a first direction, folding the first ribbon along a first fold line of the first ribbon in a first direction, folding the first ribbon along the first fold line of the first ribbon in a second direction which is opposite to the first direction, folding the second ribbon along the first fold line of the second ribbon in a second direction which is opposite to the first direction, folding the second ribbon along a second fold line of the second ribbon in a first direction, and simultaneously folding the third ribbon and the first ribbon.

This Summary is provided merely for purposes of summarizing some example embodiments so as to provide a basic understanding of some aspects of the disclosure. Accordingly, it will be appreciated that the above described example embodiments are merely examples and should not be construed to narrow the scope or spirit of the disclosure in any way. Other embodiments, aspects, and advantages of various disclosed embodiments will become apparent from the following detailed description taken in conjunction with the accompanying drawings which illustrate, by way of example, the principles of the described embodiments.

BRIEF DESCRIPTION OF THE DRAWINGS

The organization and manner of the structure and operation of the disclosed embodiments, together with further objects and advantages thereof, may best be understood by reference to the following description, taken in connection with the accompanying drawings, which are not necessarily drawn to scale, wherein like reference numerals identify like elements in which.

DETAILED DESCRIPTION

Figure 1:
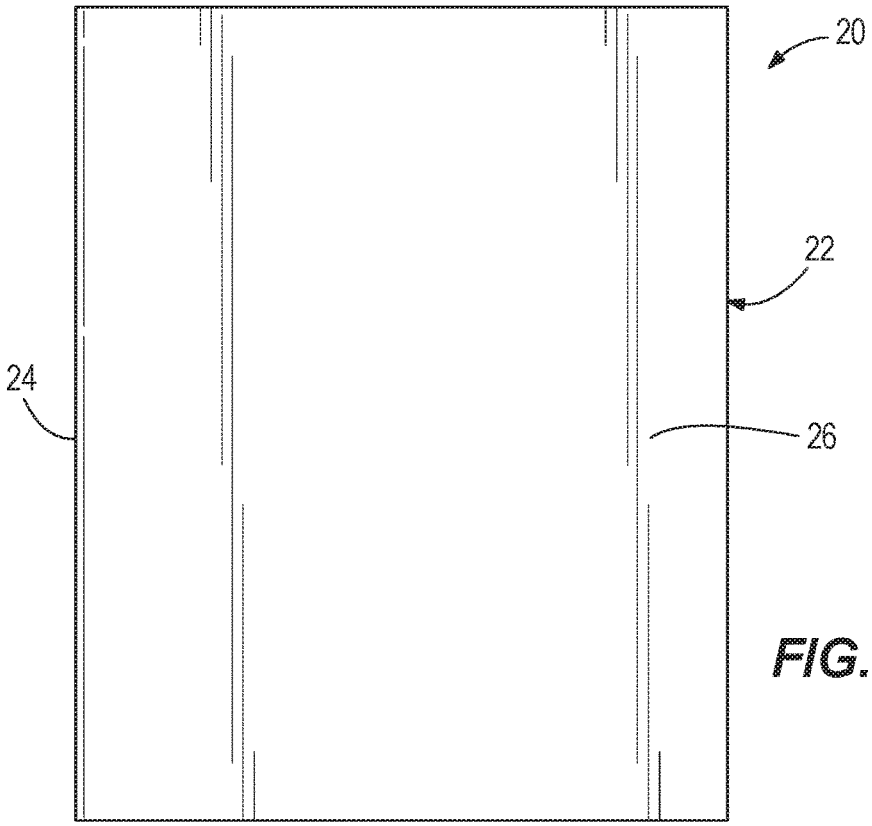
FIG. 1 depicts a top plan view of a booklet in accordance with an embodiment of the present disclosure.
Figure 2:
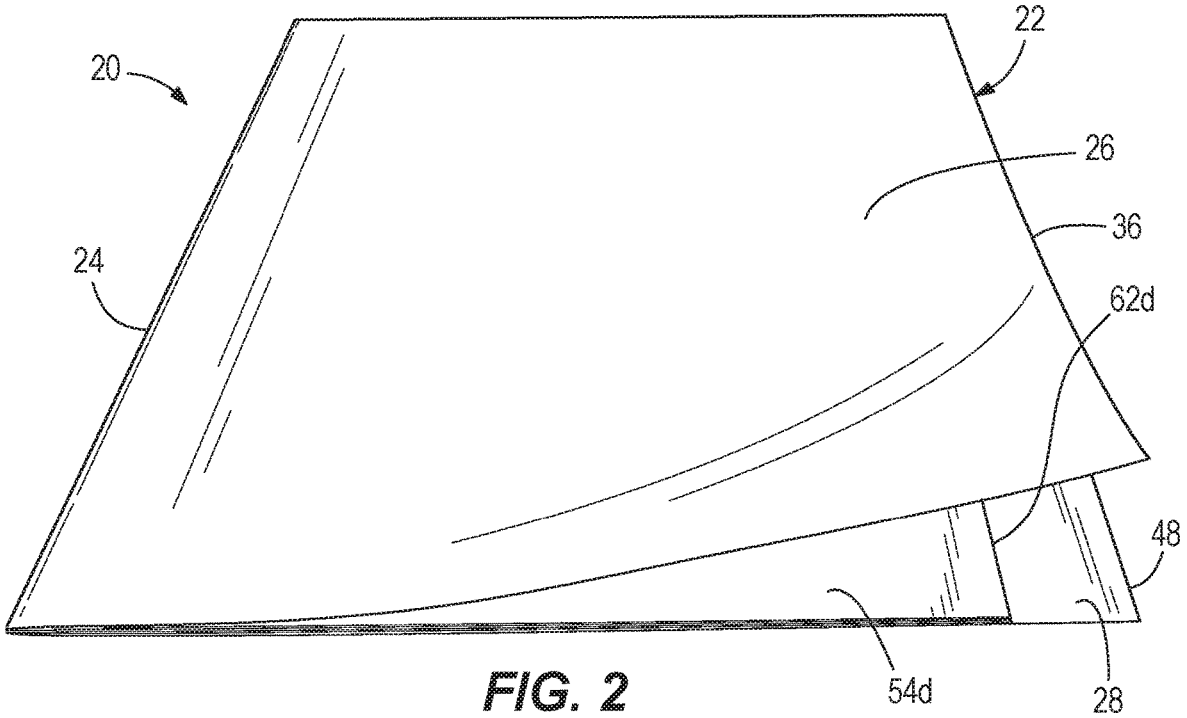
FIGS. 2 and 3 depict perspective views of the booklet shown partially opened.
Figure 3:
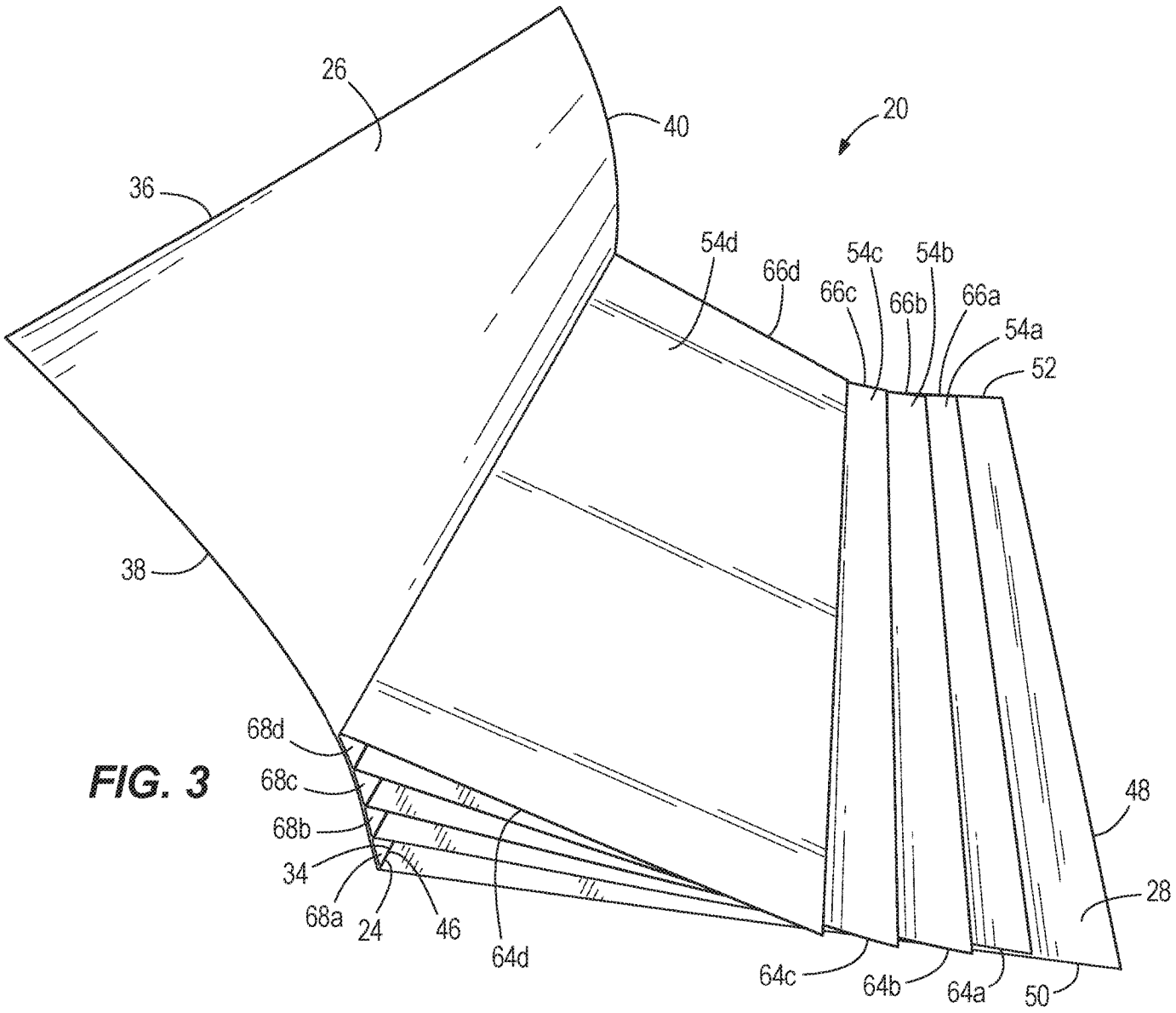

While the disclosure may be susceptible to embodiment in different forms, there is shown in the drawings, and herein will be described in detail, a specific embodiment with the understanding that the present disclosure is to be considered an exemplification of the principles of the disclosure, and is not intended to limit the disclosure to that as illustrated and described herein. Therefore, unless otherwise noted, features disclosed herein may be combined together to form additional combinations that were not otherwise shown for purposes of brevity. It will be further appreciated that in some embodiments, one or more elements illustrated by way of example in a drawing(s) may be eliminated and/or substituted with alternative elements within the scope of the disclosure.

Figure 4:
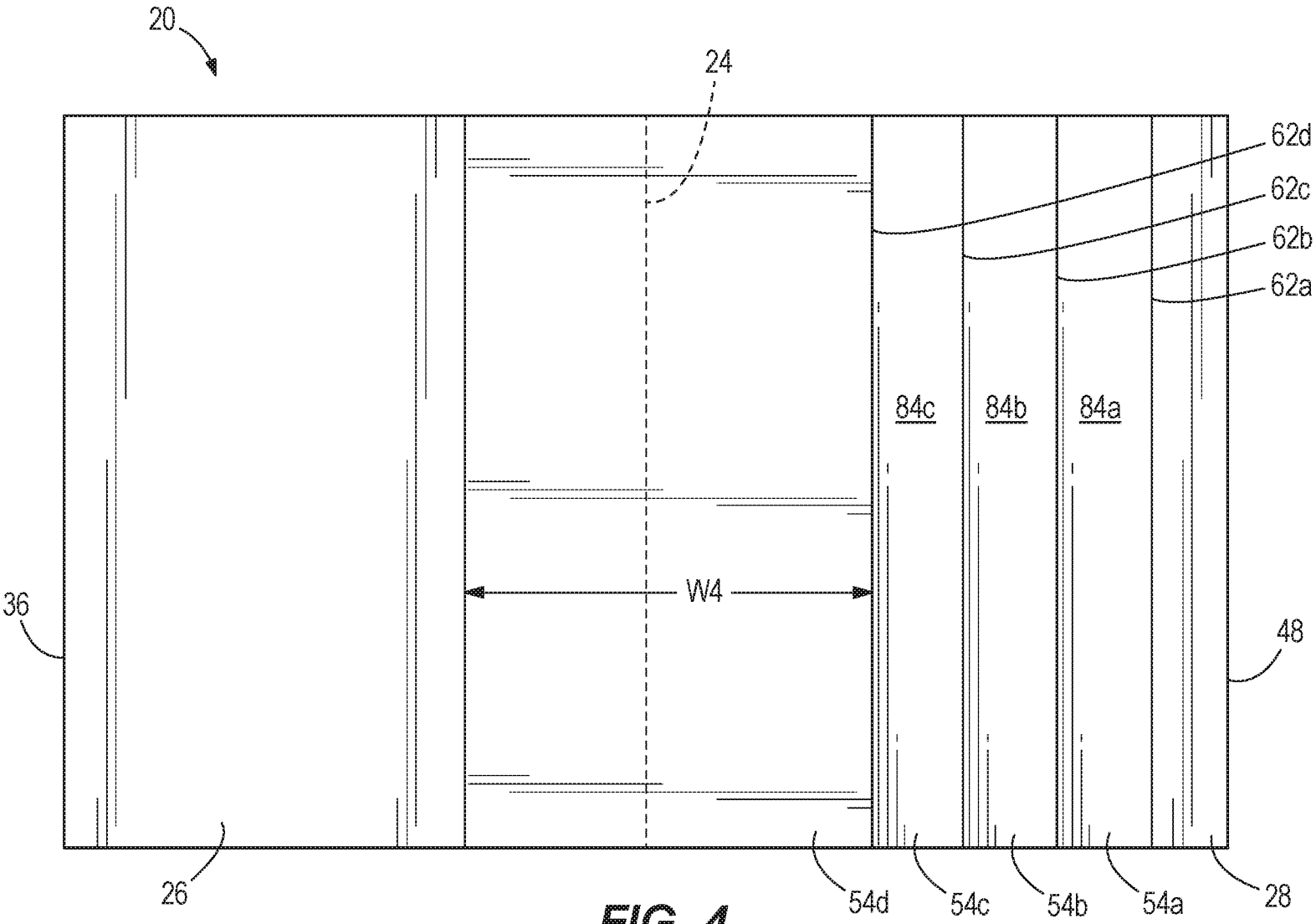
FIG. 4 depicts a top plan view of the booklet shown fully open.
Figure 5:
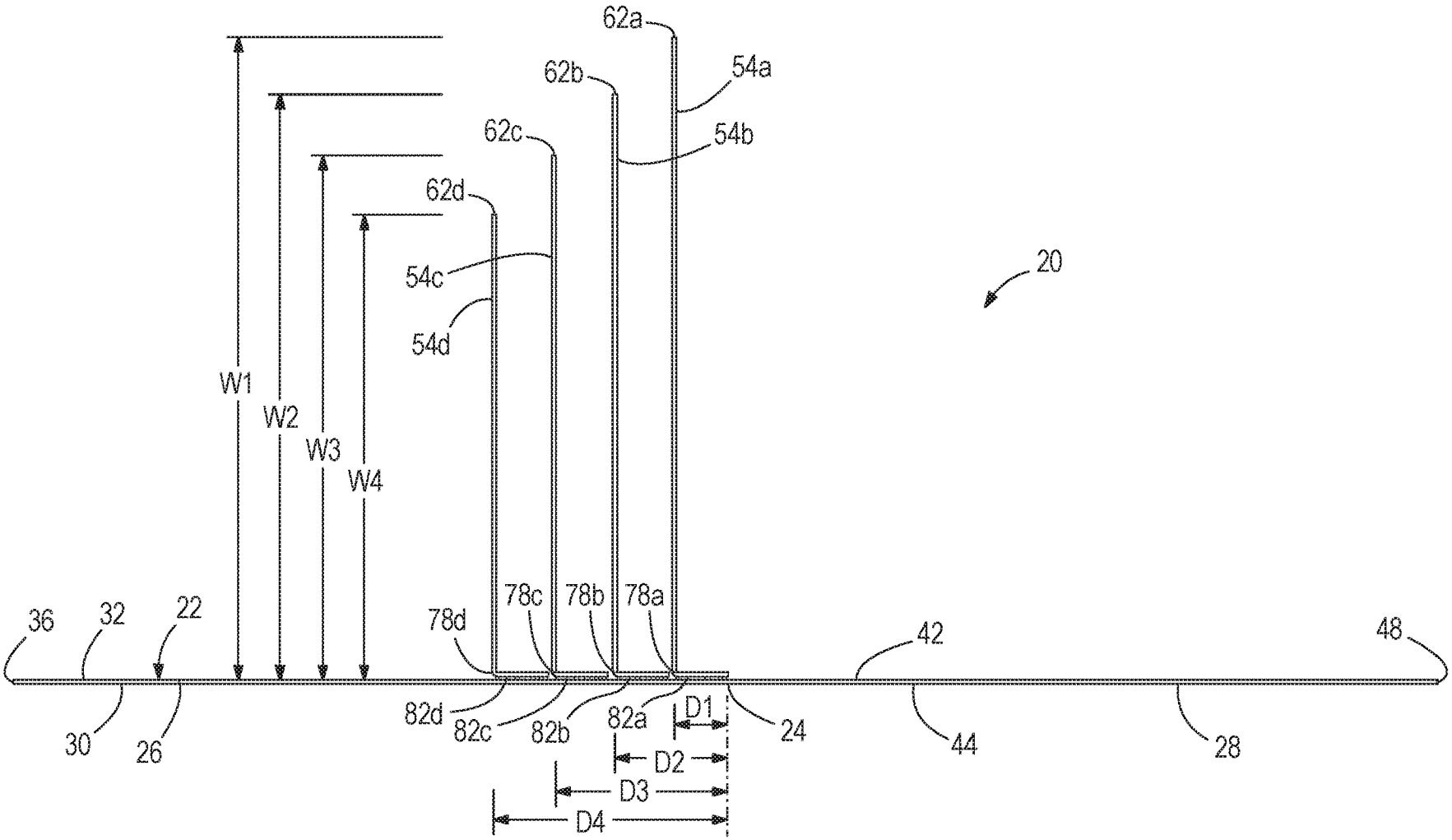
FIG. 5 depicts a side elevation view of the booklet shown open and with leaves of the booklet in an upstanding position.
Figures 5A, 5B, 5C, 5D:
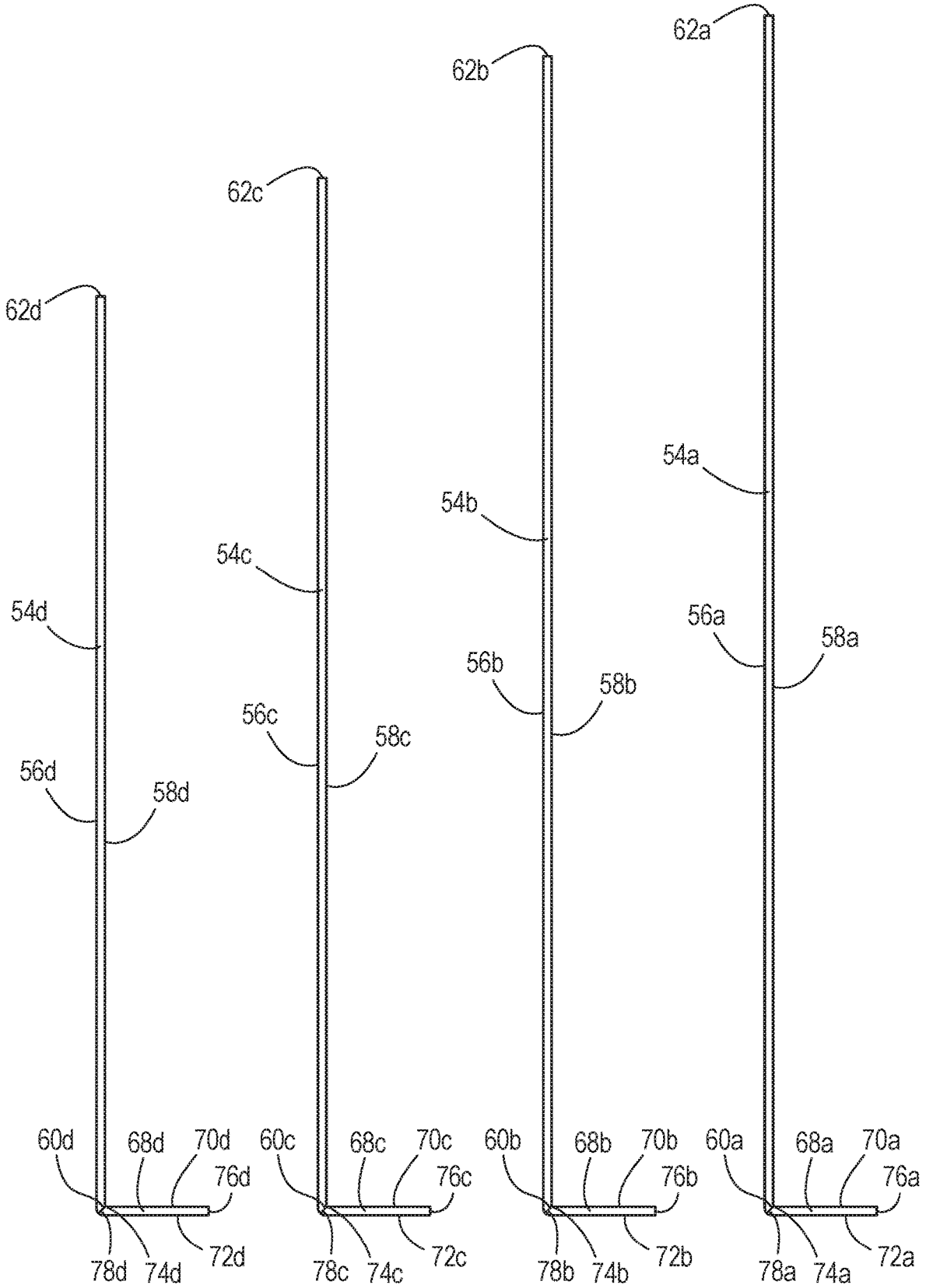
FIGS. 5A-5D depict side elevation views of leaves of the booklet shown in upstanding positions.
Figure 6:
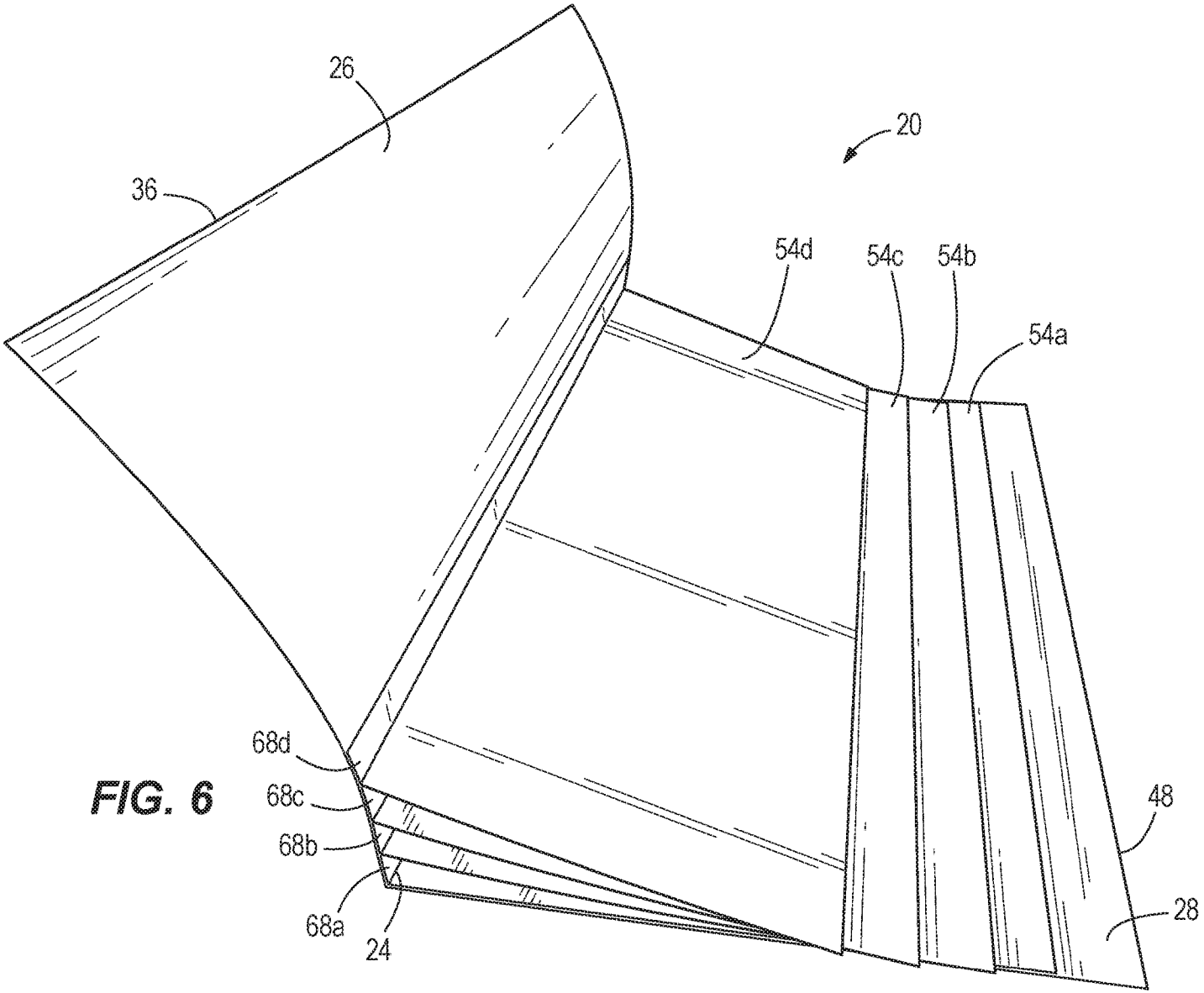
FIG. 6 depicts a perspective view of an alternate embodiment of the booklet shown partially opened.
Figure 7:
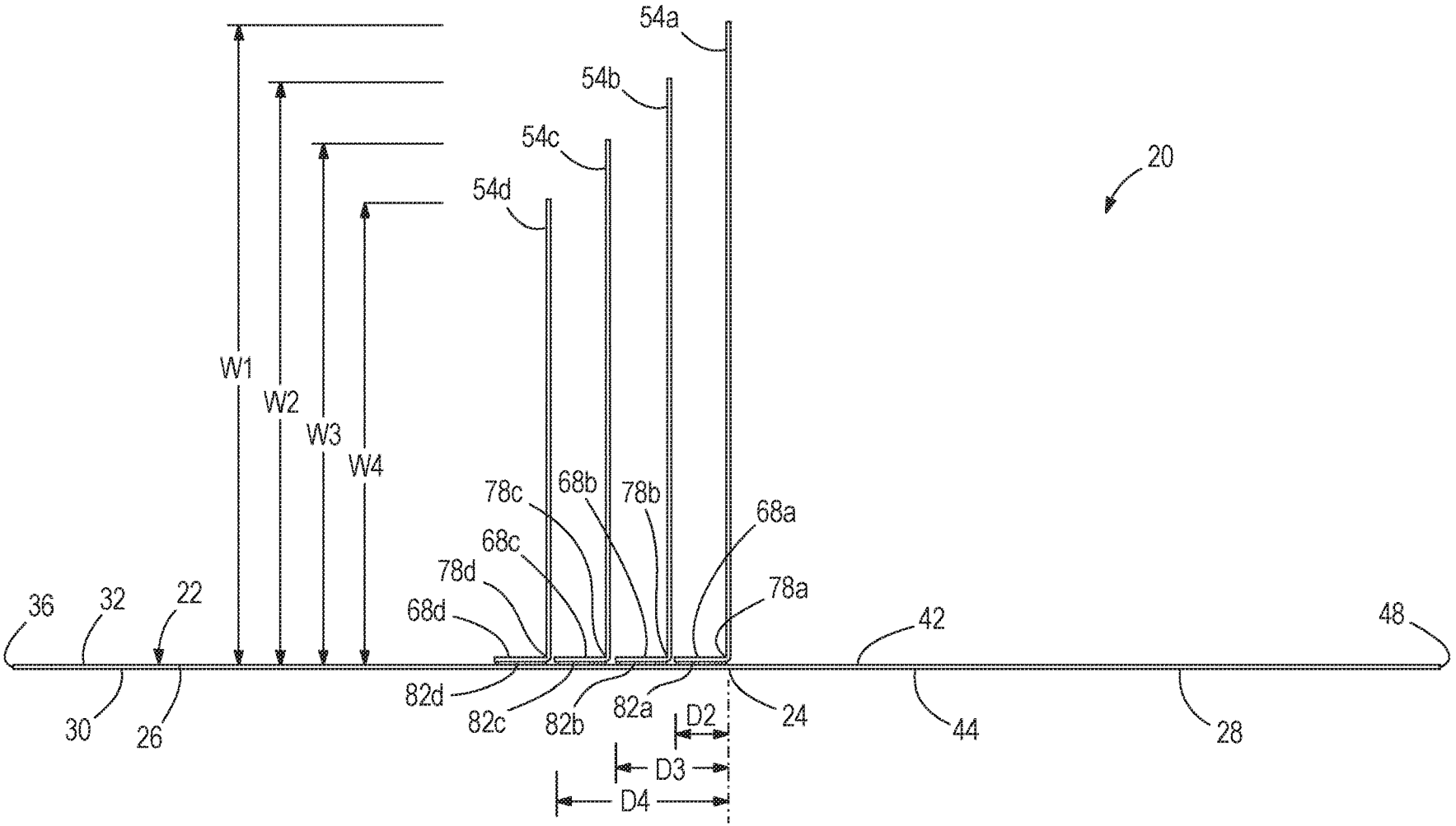
FIG. 7 depicts a side elevation view of the booklet of FIG. 6 shown open and with leaves of the booklet in an upstanding position.
Figure 16:
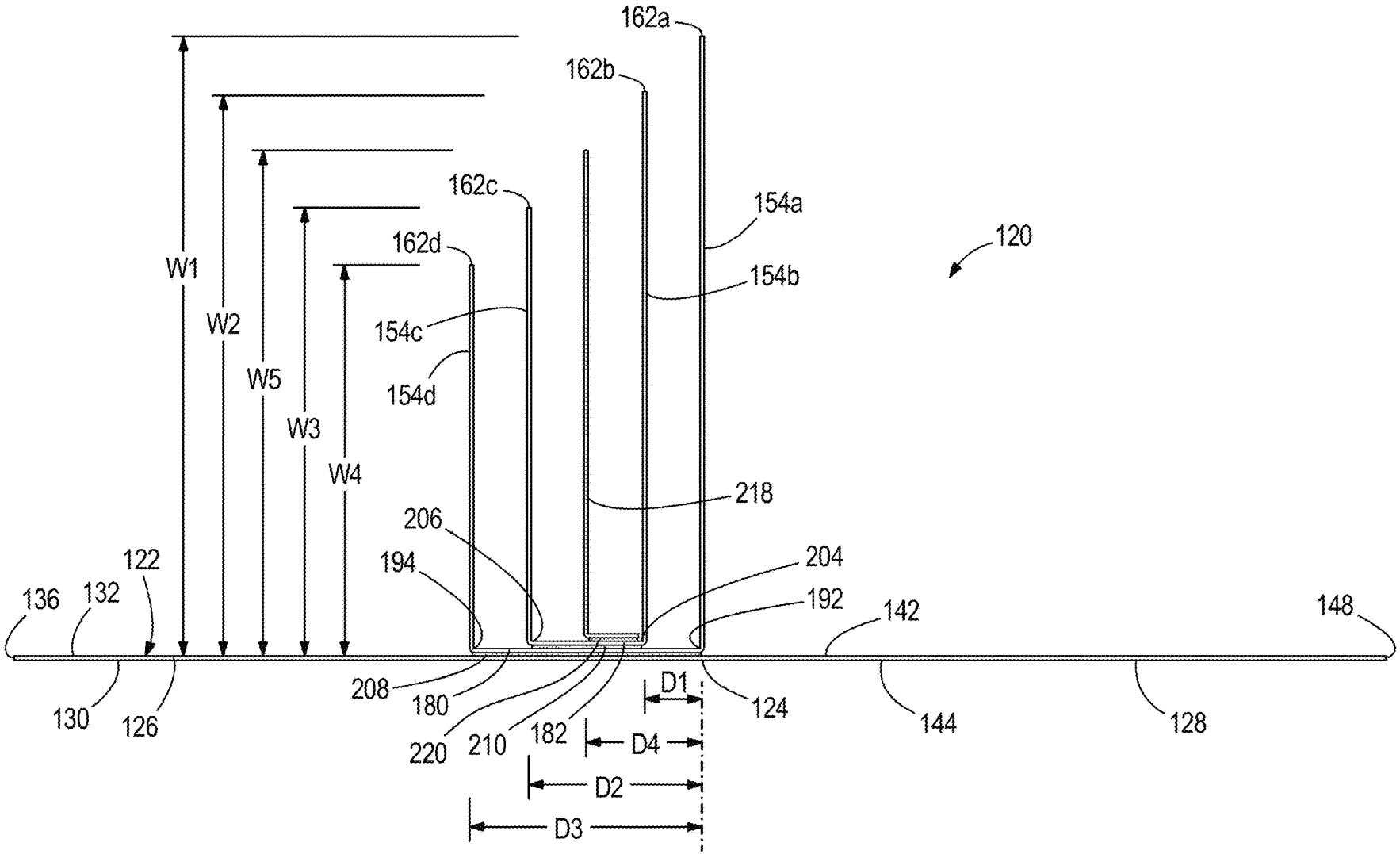
FIG. 16 depicts a side elevation view of an alternate embodiment of the booklet of FIG. 9 shown open and with leaves of the booklet in an upstanding position.
Figure 17:
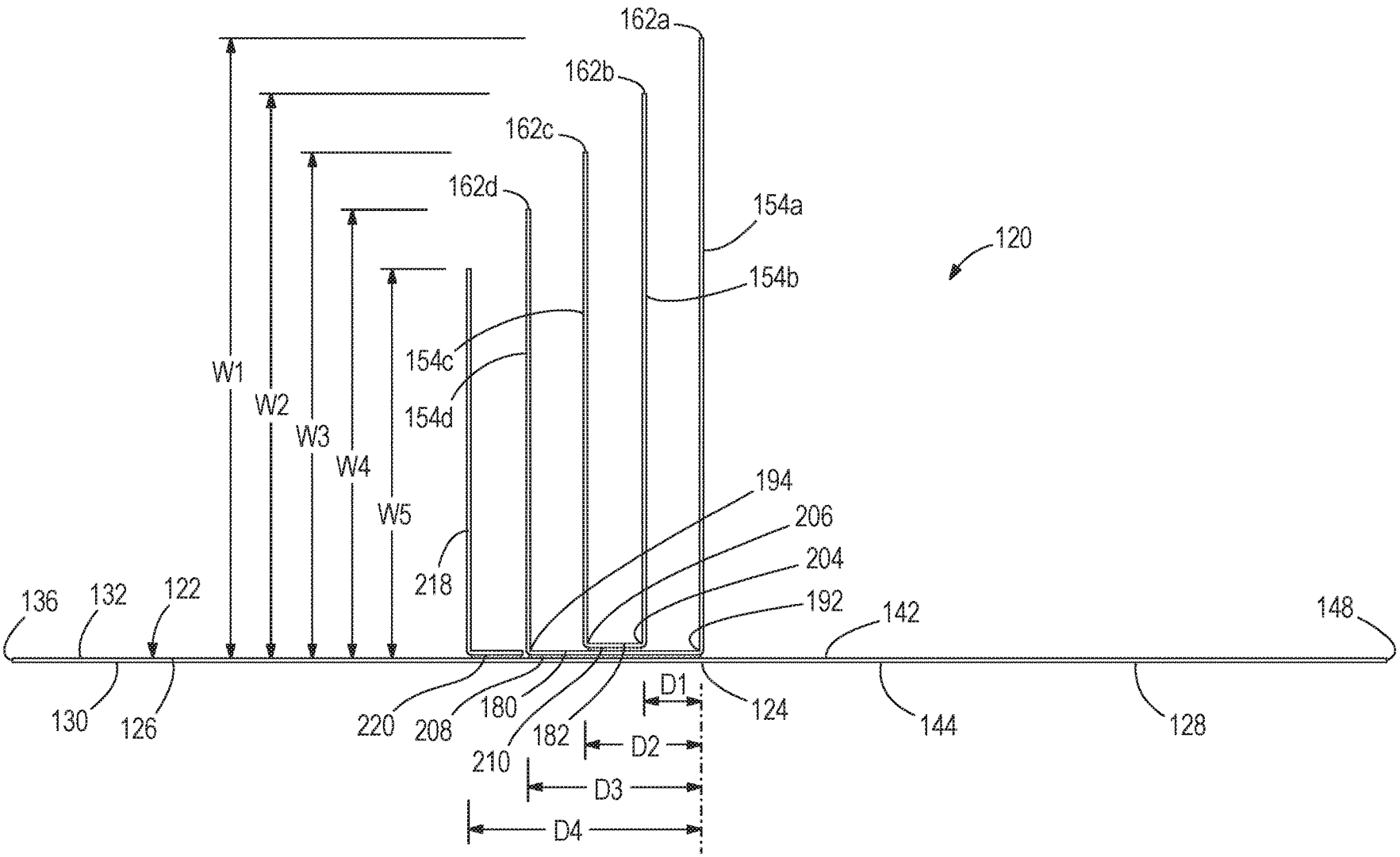
FIG. 17 depicts a side elevation view of yet another alternate embodiment of the booklet of FIG. 9 shown open and with leaves of the booklet in an upstanding position.

FIGS. 1-5D illustrate a first embodiment of a booklet 20, FIGS. 6 and 7 illustrate an alternate first embodiment of the booklet 20, FIGS. 9-14B illustrate a second embodiment of a booklet 120, and FIGS. 16 and 17 illustrate an alternate second embodiment of the booklet 120. The booklet 20, 120 may be used for various purposes, including but not limited to, advertising, fiction material, nonfiction material, artwork or other written materials. The booklet 20, 120 is may be constructed from paper or a cellulose pulp material, however the construction may further include polymeric or other thin material that may receive writing, printing, or drawing.

Figure 9:
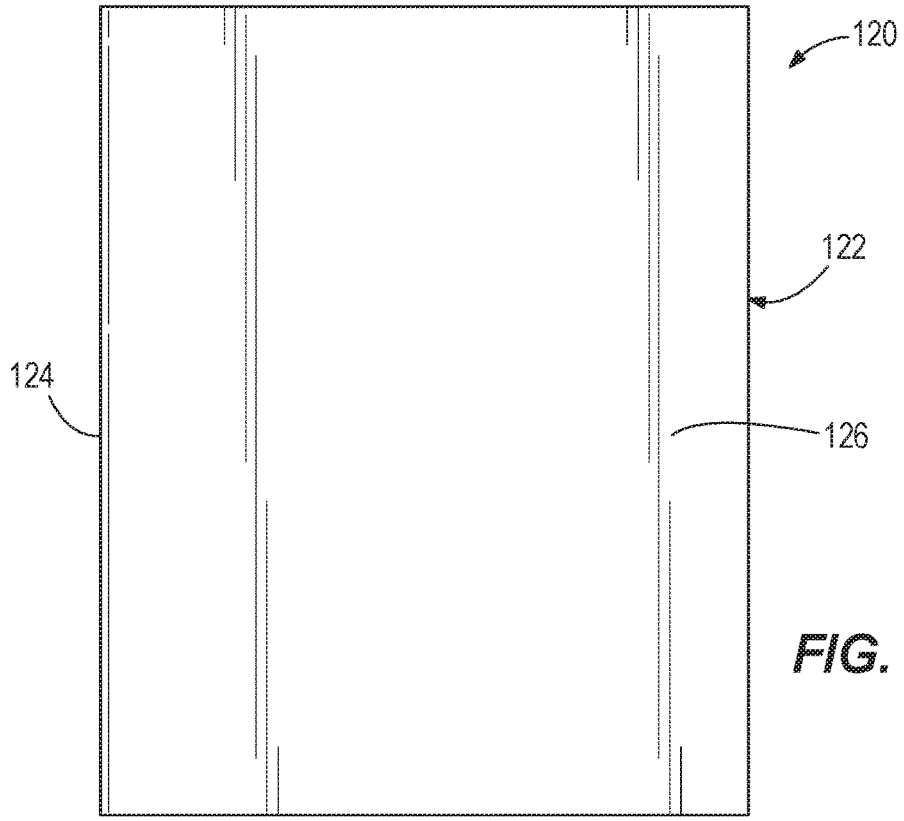
FIG. 9 depicts a top plan view of a booklet in accordance with another embodiment of the present disclosure.
Figure 10:
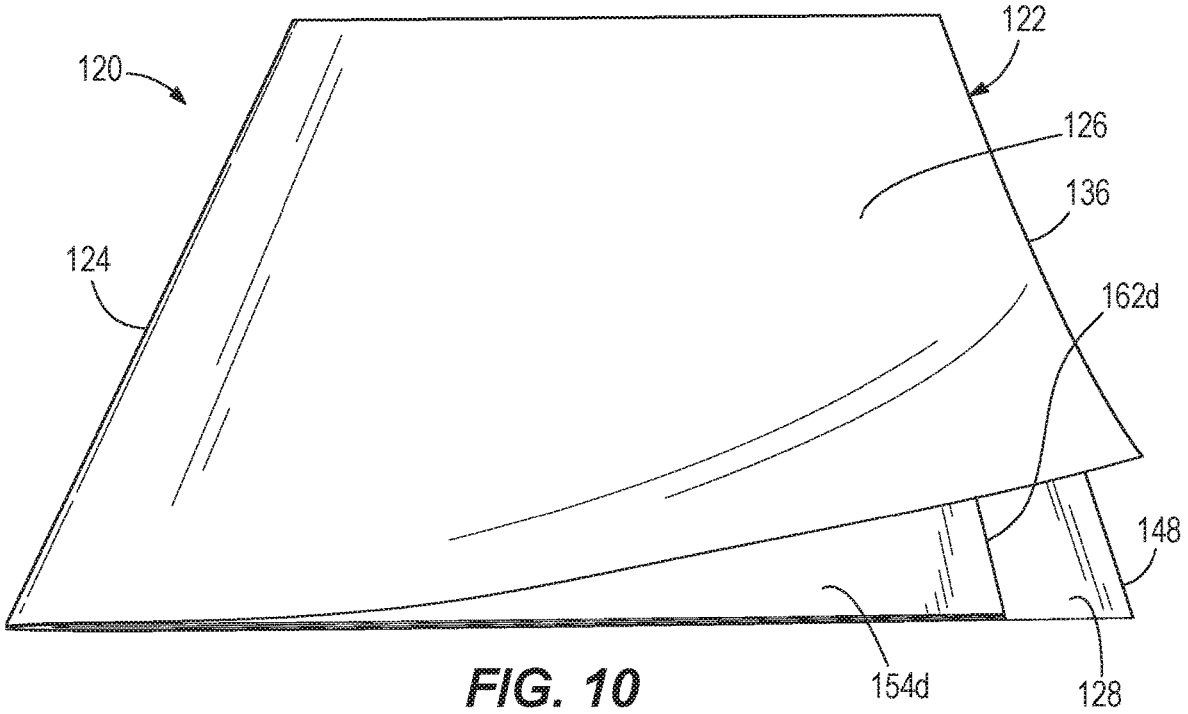
FIGS. 10 and 11 depict perspective views of the booklet of FIG. 9 shown partially opened.
Figure 11:
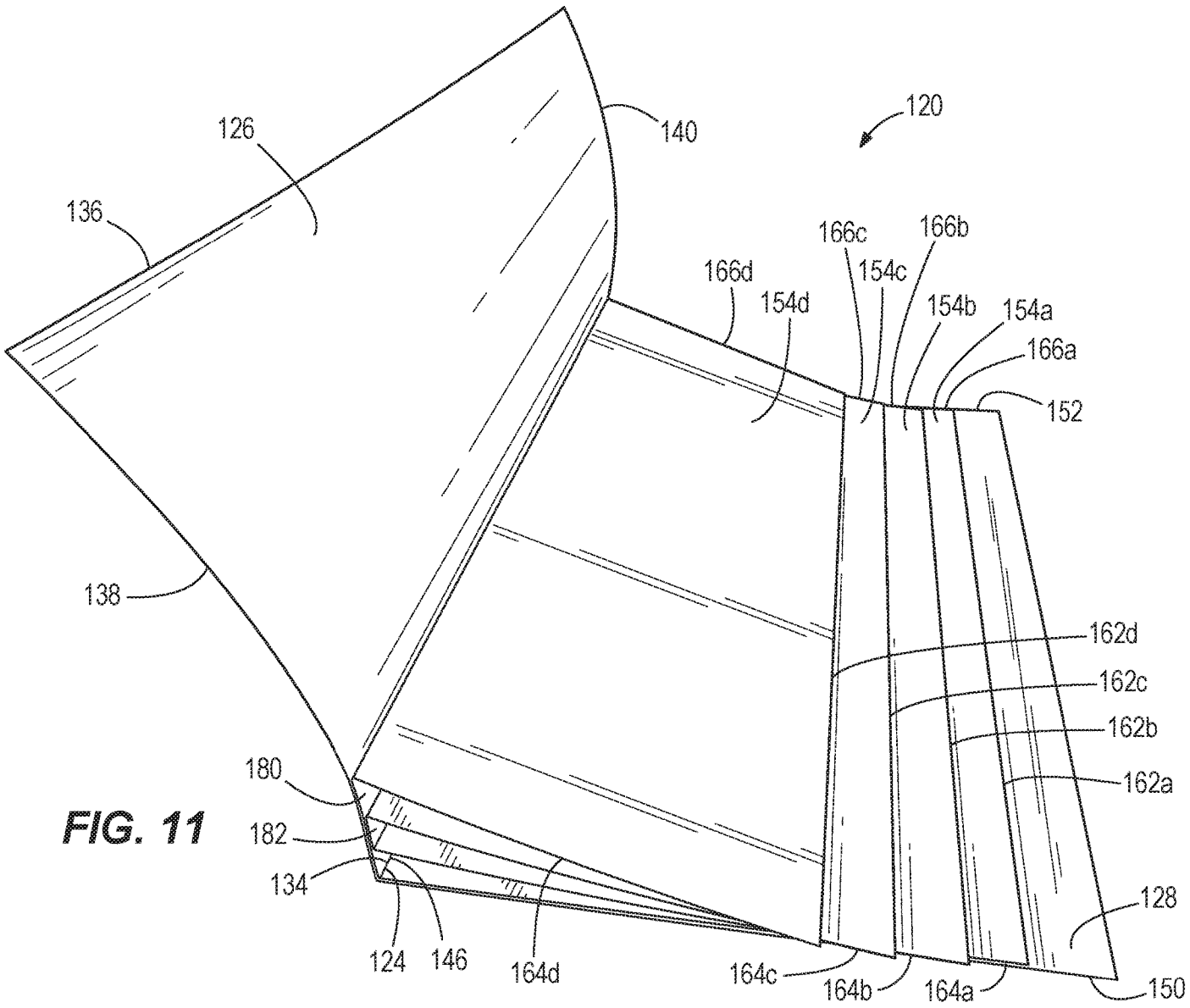
Figure 12:
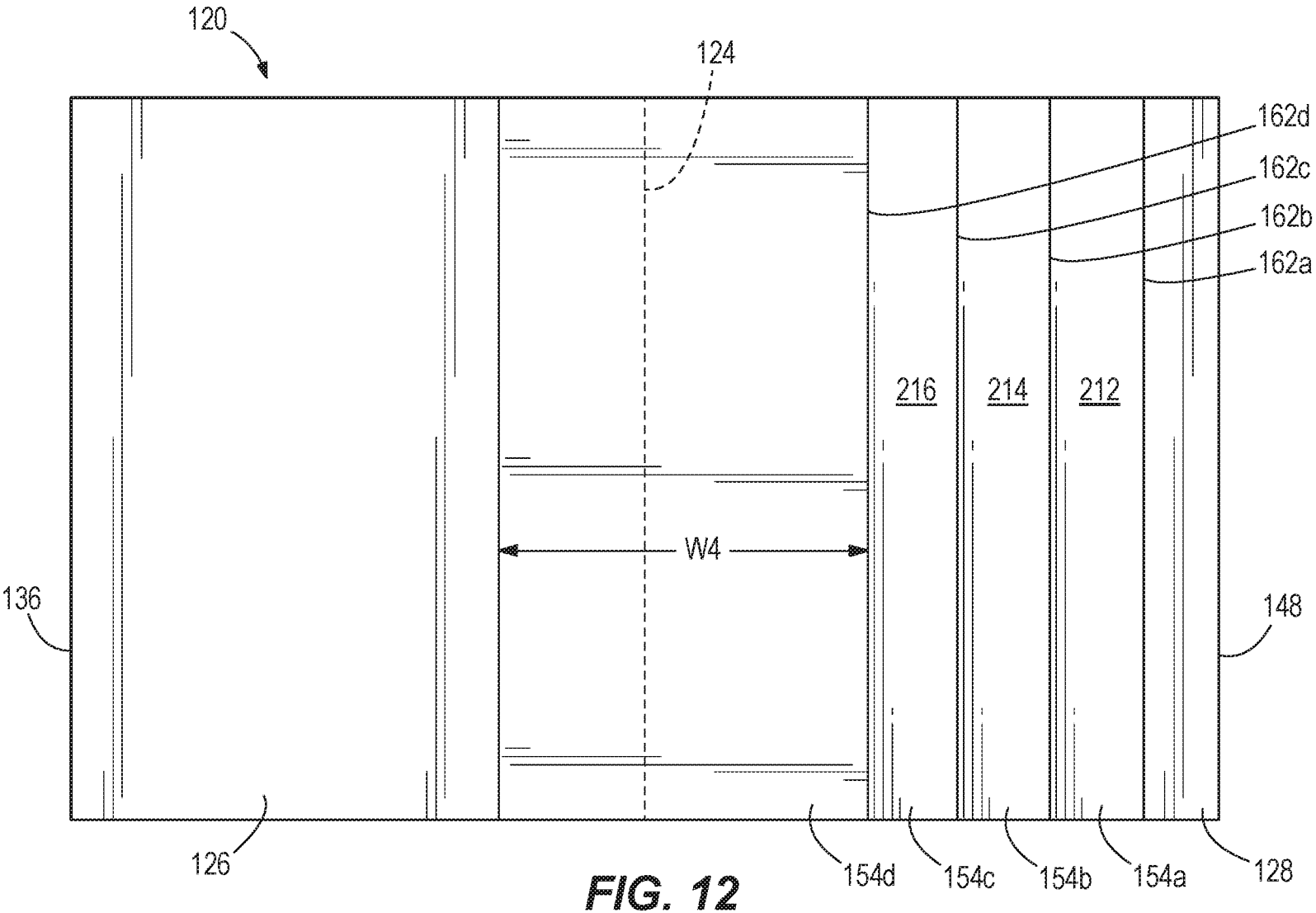
FIG. 12 depicts a top plan view of the booklet of FIG. 9 shown fully open.

The booklet 20, 120 includes an exterior cover 22, 122 having a hinge fold 24, 124 positioned between a front cover sheet 26, 126 and a rear cover sheet 28, 128 for pivoting the front cover sheet 26, 126 between a closed position, see FIGS. 1 and 9, and an open position, see FIGS. 4 and 12. The "front" and "rear" of each component of the booklet 20, 120 is described with regard to the orientation shown in FIGS. 1 and 9.

The front cover sheet 26, 126 has a front surface 30, 130, a rear surface 32, 132, an inner edge 34, 134, an outer edge 36, 136 and side edges 38, 40, 138, 140 extending between the inner and outer edges 34, 36, 134, 136. The inner and outer edges 34, 36, 134, 136 may be parallel to each other. The side edges 38, 40, 138, 140 may parallel to each other. The side edges 38, 40, 138, 140 may be perpendicular to the inner and outer edges 34, 36, 134, 136.

The rear cover sheet 28, 128 has a front surface 42, 142, a rear surface 44, 144, an inner edge 46, 146, an outer edge 48, 148 and side edges 50, 52, 150, 152 extending between the inner and outer edges 46, 48, 146, 148. The inner and outer edges 46, 48, 146, 148 may be parallel to each other. The side edges 50, 52, 150, 152 may parallel to each other. The side edges 50, 52, 150, 152 may be perpendicular to the inner and outer edges 46, 48, 146, 148. The inner edges 34, 46 form the hinge fold 24.

In some embodiments, the front and rear cover sheets 26, 126, 28, 128 have the same lengths and widths such that when the booklet 20, 120 is in the closed position, the front and rear cover sheets 26, 126, 28, 128 completely overlap each other. In other embodiments, the front and rear cover sheets 26, 126, 28, 128 do have the same lengths and/or widths such that when the booklet 20, 120 is in the closed position, the front and rear cover sheets 26, 126, 28, 128 do not completely overlap each other.

An interior leaf sheet 54*a*, 154*a* which is proximate to the hinge fold 24, 124 has a front surface 56*a*, 156*a*, a rear surface 158*a*, 158*a*, an inner edge 60*a*, 160*a*, an outer edge 62*a*, 162*a* and side edges 64*a*, 66*a*, 164*a*, 166*a* extending between the inner and outer edges 60*a*, 62*a*, 160*a*, 162*a*. The inner and outer edges 60*a*, 62*a*, 160*a*, 162*a* may be parallel to each other. The side edges 64*a*, 66*a*, 164*a*, 166*a* may parallel to each other. The side edges 64*a*, 66*a*, 164*a*, 166*a* may be perpendicular to the inner and outer edges 60*a*, 62*a*, 160*a*, 162*a*. A leaf width W1 is defined between the inner and outer edges 60*a*, 62*a*, 160*a*, 162*a*.

An interior leaf sheet 54*b*, 154*b* which is proximate to the leaf sheet 54*a*, 154*a* has a front surface 56*b*, 156*b*, a rear surface 158*b*, 158*b*, an inner edge 60*b*, 160*b*, an outer edge 62*b*, 162*b* and side edges 64*b*, 66*b*, 164*b*, 166 extending between the inner and outer edges 60*b*, 62*b*, 160*b*, 162*b*. The inner and outer edges 60*b*, 62*b*, 160*b*, 162*b* may be parallel to each other. The side edges 64*b*, 66*b*, 164*b*, 166*b* may parallel to each other. The side edges 64*b*, 66*b*, 164*b*, 166*b* may be perpendicular to the inner and outer edges 60*b*, 62*b*, 160*b*, 162*b*. A leaf width W2 is defined between the inner and outer edges 60*b*, 62*b*, 160*b*, 162*b*. The leaf width W2 is less than the leaf width W1.

An interior leaf sheet 54*c*, 154*c* which is proximate to the leaf sheet 54*b*, 154*b* has a front surface 56*c*, 156*c*, a rear surface 158*c*, 158*c*, an inner edge 60*c*, 160*c*, an outer edge 62*c*, 162*c* and side edges 64*c*, 66*c*, 164*c*, 166*c* extending between the inner and outer edges 60*c*, 62*c*, 160*c*, 162*c*. The inner and outer edges 60*c*, 62*c*, 160*c*, 162*c* may be parallel to each other. The side edges 64*c*, 66*c*, 164*c*, 166*c* may parallel to each other. The side edges 64*c*, 66*c*, 164*c*, 166*c* may be perpendicular to the inner and outer edges 60*c*, 62*c*, 160*c*, 162*c*. A leaf width W3 is defined between the inner and outer edges 60*c*, 62*c*, 160*c*, 162*c*. The leaf width W3 is less than the leaf width W2.

An interior leaf sheet 54*d*, 154*d* which is proximate to the leaf sheet 54*c*, 154*c* has a front surface 56*d*, 156*d*, a rear surface 158*d*, 158*d*, an inner edge 60*d*, 160*d*, an outer edge 62*d*, 162*d* and side edges 64*d*, 66*d*, 164*d*, 166*d* extending between the inner and outer edges 60*d*, 62*d*, 160*d*, 162*d*. The inner and outer edges 60*d*, 62*d*, 160*d*, 162*d* may be parallel to each other. The side edges 64*d*, 66*d*, 164*d*, 166*d* may parallel to each other. The side edges 64*d*, 66*d*, 164*d*, 166*d* may be perpendicular to the inner and outer edges 60*d*, 62*d*, 160*d*, 162*d*. A leaf width W4 is defined between the inner and outer edges 60*d*, 62*d*, 160*d*, 162*d*. The leaf width W4 is less than the leaf width W3.

Leaf sheet 54*a*, 154*a* is proximate to the hinge fold 24, 124 and leaf sheet 54*d*, 154*d* is closest to the outer edge 36, 136. Leaf sheet 54*b*, 154*b* is proximate to leaf sheet 54*a*, 154*a*. Leaf sheet 54*c*, 154*c* is proximate to leaf sheet 54*b*, 154*b*. Leaf sheet 54*d*, 154*d* is proximate to leaf sheet 54*c*, 154*d*. Leaf sheet 54*b*, 154*b* is between leaf sheet 54*a*, 154*a* and leaf sheet 54*c*, 154*c*. Leaf sheet 54*c*, 154*c* is between leaf sheet 54*b*, 154*b* and leaf sheet 54*d*, 154*d*. The leaf sheets 54*a*, 154*a*, 54*b*, 154*b*, 54*c*, 154*c*, 54*d*, 154*d* have progressively smaller leaf widths as the leaf sheets 54*a*, 154*a*, 54*b*, 154*b*, 54*c*, 154*c*, 54*d*, 154*d* progress outwardly from the hinge fold 24. In some embodiments and as shown, the difference between leaf width W1 and leaf width W2, the difference between leaf width W2 and leaf width W3, and the difference between leaf width W3 and leaf width W4 are the same. In some embodiments, the differences between the leaf widths are not the same.

Each leaf sheet 54*a*, 154*a*, 54*b*, 154*b*, 54*c*, 154*c*, 54*d*, 154*d* has a length which is defined between the side edges 64*a*, 66*a*, 164*a*, 166*a*, 64*b*, 66*b*, 164*b*, 166*b*, 64*c*, 66*c*, 164*c*, 166*c*, 64*d*, 66*d*, 164*d*, 166*d*. In an embodiment, the length of each leaf sheet 54*a*, 154*a*, 54*b*, 154*b*, 54*c*, 154*c*, 54*d*, 154*d* is the same, and is the same as the lengths of the front and rear cover sheets 26, 126, 28, 128. In an embodiment, the length of each leaf sheet 54*a*, 154*a*, 54*b*, 154*b*, 54*c*, 154*c*, 54*d*, 154*d* is not the same, and/or is not same as the lengths of the front and rear cover sheets 26, 126, 28, 128.

Attention is now invited to the first embodiment of the booklet 20 shown in FIGS. 1-5D. Leaf sheet 54*a* is attached to the front cover sheet 26 by an integrally formed spine sheet 68*a* and forms a leaf; leaf sheet 54*b* is attached to the front cover sheet 26 by an integrally formed spine sheet 68*b* and forms a leaf; leaf sheet 54*c* is attached to the front cover sheet 26 by an integrally formed spine sheet 68*c* and forms a leaf; leaf sheet 54*d* is attached to the front cover sheet 26 by an integrally formed spine sheet 68*d* and forms a leaf.

Spine sheet 68*a* has a rear surface 70*a*, a front surface 72*a*, an outer edge 74*a*, an inner edge 76*a* and side edges extending between the outer and inner edges 74*a*, 76*a*. The outer and inner edges 74*a*, 76*a* may be parallel to each other. The side edges may parallel to each other and may be perpendicular to the outer and inner edges 74*a*, 76*a*. Leaf sheet 54*a* and spine sheet 68*a* are pivotable relative to each by a hinge fold 78*a* which is provided at the inner edge 60*a* of the leaf sheet 54*a* and the outer edge 74*a* of the spine sheet 68*a*.

Spine sheet 68*b* has a rear surface 70*b*, a front surface 72*b*, an outer edge 74*b*, an inner edge 76*b* and side edges extending between the outer and inner edges 74*b*, 76*b*. The outer and inner edges 74*b*, 76*b* may be parallel to each other. The side edges may parallel to each other and may be perpendicular to the outer and inner edges 74*b*, 76*b*. Leaf sheet 54*b* and spine sheet 68*b* are pivotable relative to each by a hinge fold 78*b* which is provided at the inner edge 60*b* of the leaf sheet 54*b* and the outer edge 74*b* of the spine sheet 68*b*.

Spine sheet 68*c* has a rear surface 70*c*, a front surface 72*c*, an outer edge 74*c*, an inner edge 76*c* and side edges extending between the outer and inner edges 74*c*, 76*c*. The outer and inner edges 74*c*, 76*c* may be parallel to each other. The side edges may parallel to each other and may be perpendicular to the outer and inner edges 74*c*, 76*c*. Leaf sheet 54*c* and spine sheet 68*c* are pivotable relative to each by a hinge fold 78*c* which is provided at the inner edge 6*c*0*c* of the leaf sheet 54*c* and the outer edge 74*c* of the spine sheet 68*c*.

Spine sheet 68*d* has a rear surface 70*d*, a front surface 72*d*, an outer edge 74*d*, an inner edge 76*d* and side edges extending between the outer and inner edges 74*d*, 76*d*. The outer and inner edges 74*d*, 76*d* may be parallel to each other. The side edges may parallel to each other and may be perpendicular to the outer and inner edges 74*d*, 76*d*. Leaf sheet 54*d* and spine sheet 68*d* are pivotable relative to each by a hinge fold 78*d* which is provided at the inner edge 6*d*0*d* of the leaf sheet 54*d* and the outer edge 74*d* of the spine sheet 68*d*.

Spine sheet 68*d* has a rear surface 70*d*, a front surface 72*d*, an outer edge 74*d*, an inner edge 76*d* and side edges extending between the outer and inner edges 74*d*, 76*d*. The outer and inner edges 74*d*, 76*d* may be parallel to each other. The side edges may parallel to each other and may be perpendicular to the outer and inner edges 74*d*, 76*d*. Leaf sheet 54*d* and spine sheet 68*d* are pivotable relative to each by a hinge fold 78*d* which is provided at the inner edge 6*d*0*d* of the leaf sheet 54*d* and the outer edge 74*d* of the spine sheet 68*d*.

The front surface 72, 72*b*, 72*c*, 72*d* of each spine sheet 68*a*, 68*b*, 68*c*, 68*d* is secured directly to the rear surface 32 of the front cover sheet 26 by a binder 82*a*, 82*b*, 82*c*, 82*d*, such as an adhesive layer, and the respective leaf sheet 54*a*, 54*b*, 54*c*, 54*d* extends freely therefrom. Each spine sheet 68*a*, 68*b*, 68*c*, 68*d* extends from the respective leaf sheet 54*a*, 54*b*, 54*c*, 54*d* in the same direction. All of the spine sheets 68*a*, 68*b*, 68*c*, 68*d* extend toward the hinge fold 24. In an embodiment, the inner end 76*a* of spine sheet 68*a* is proximate to the hinge fold 24, the inner end 76*b* of spine sheet 68*b* can abut against the hinge fold 78*a* as shown or the inner end 76*b* can be spaced from the hinge fold 78*a*, the inner end 76*c* of spine sheet 68*c* can abut against the hinge fold 78*b* as shown or the inner end 76*c* can be spaced from the hinge fold 78*b*, the inner end 76*d* of spine sheet 68*d* can abut against the hinge fold 78*c* as shown or the inner end 76*d* can be spaced from the hinge fold 78*c*. Each spine sheet 68*a*, 68*b*, 68*c*, 68*d* is separated from each other, such that each spine sheet 68*a*, 68*b*, 68*c*, 68*d* is individual and discontinuous from each other.

As shown in FIG. 5, the leaf formed by leaf sheet 54*a* and spine sheet 68*a* are L-shaped when in an upstanding position; the leaf formed by leaf sheet 54*b* and spine sheet 68*b* are L-shaped when in an upstanding position; the leaf formed by leaf sheet 54*c* and spine sheet 68*c* are L-shaped when in an upstanding position; and the leaf formed by leaf sheet 54*d* and spine sheet 68*d* are L-shaped when in an upstanding position.

The distance between the hinge fold 24 and the hinge fold 78*a* defines a leaf offset dimension D1; the distance between the hinge fold 24 and the hinge fold 78*b* defines a leaf offset dimension D2; the distance between the hinge fold 24 and the hinge fold 78*c* defines a leaf offset dimension D3; and the distance between the hinge fold 24 and the hinge fold 78*d* defines a leaf offset dimension D4. In an embodiment, the leaf offset dimension D2 is two times the leaf offset dimension D1, the leaf offset dimension D3 is three times the leaf offset dimension D1, and the leaf offset dimension D4 is three times the leaf offset dimension D1. In some embodiments and as shown, the difference between leaf offset dimension D1 and leaf offset dimension D2, the difference between leaf offset dimension D2 and leaf offset dimension D3, and the difference between leaf offset dimension D3 and leaf offset dimension D4 are the same such that the leaf sheets 54*a*, 54*b*, 54*c*, 54*d* are equally spaced from each other. In some embodiments, the differences between the leaf offset dimensions are not the same such that the leaf sheets 54*a*, 54*b*, 54*c*, 54*d* are not equally spaced from each other. Each spine sheet 68*a*, 68*b*, 68*c*, 68*d* may have the same length defined between the edges 74*a*, 76*a*, 74*b*, 76*b*, 74*d*, 76*c*, 74*d*, 76*d*, or one or more of the spine sheets 68*a*, 68*b*, 68*c*, 68*d* may have different lengths.

Alternatively, as shown in FIGS. 6 and 7, the leaf formed by the leaf sheet 54*a* and spine sheet 68*a* has its hinge fold 78*a* aligned with the hinge fold 24 of the cover 22 and all of the spine sheets 68*a*, 68*b*, 68*c*, 68*d* extend away from the hinge fold 24 such that the leaf offset dimension D1 is eliminated. Accordingly, the distance between the hinge fold 24 and the hinge fold 78*b* defines leaf offset dimension D2; the distance between the hinge fold 24 and the hinge fold 78*c* defines leaf offset dimension D3; the distance between the hinge fold 24 and the hinge fold 78*d* defines leaf offset dimension D4. In an embodiment, the leaf offset dimension D3 is two times the leaf offset dimension D2, and the leaf offset dimension D4 is three times the leaf offset dimension D2. While the leaf sheets 54*a*, 54*b*, 54*c*, 54*d* are shown as being equally spaced from each other, the leaves can be secured to the front cover sheet 26 such that the leaf sheets 54*a*, 54*b*, 54*c*, 54*d* are not equally spaced from each other.

In an embodiment, when the front cover sheet 26 is in the closed position, the outer edges 62*a*, 62*b*, 62*c*, 62*d* align with each other and are spaced from the outer edges 36, 48 of the front and rear cover sheets 26, 28.

The leaf offset dimension D2 and the leaf width W2 causes the leaf sheet 54*b* to be displaced relative to the leaf sheet 54*a* and create a step display tab area 84*a* on the front surface 56*a* of the leaf sheet 54*a* that is progressively revealed adjacent to the outer edge 62*b* of the leaf sheet 54*b* during pivoting the front cover sheet 26 between the closed position and the open position around the hinge fold 24. A symbol may be imprinted on the step display tab area 84*a* identifying a subject matter imprinted on the rear surface 158*b* of the leaf sheet 54*b* and the front surface 56*a* of the leaf sheet 54*a*. The symbol may include but not limited to numbers, letters, colors, patterns, textures or other matter.

The leaf offset dimension D3 and the leaf width W3 causes the leaf sheet 54*c* to be displaced relative to the leaf sheet 54*b* and create a step display tab area 84*b* on the front surface 56*b* of the leaf sheet 54*b* that is progressively revealed adjacent to the outer edge 62*c* of the leaf sheet 54*c* during pivoting the front cover sheet 26 between the closed position and the open position around the hinge fold 24. A symbol may be imprinted on the step display tab area 84*b* identifying a subject matter imprinted on the rear surface 158*c* of the leaf sheet 54*c* and the front surface 56*b* of the leaf sheet 54*b*. The symbol may include but not limited to numbers, letters, colors, patterns, textures or other matter.

The fourth leaf offset dimension D4 and the leaf width W4 causes the fourth leaf sheet 54*d* to be displaced relative to the leaf sheet 54*c* and create a step display tab area 84*c* on the front surface 56*c* of the leaf sheet 54*c* that is progressively revealed adjacent to the outer edge 62*d* of the fourth leaf sheet 54*d* during pivoting the front cover sheet 26 between the closed position and the open position around the hinge fold 24. A symbol may be imprinted on the step display tab area 84*c* identifying a subject matter imprinted on the rear surface 158*d* of the fourth leaf sheet 54*d* and the front surface 56*c* of the leaf sheet 54*c*. The symbol may include but not limited to numbers, letters, colors, patterns, textures or other matter.

If the leaf offset dimension D1 is provided, the leaf offset dimension D1 and the leaf width W1 causes the leaf sheet 54*a* to be displaced relative to the rear cover sheet 28 during pivoting the front cover sheet 26 between the closed position and the open position around the hinge fold 24. A symbol may be imprinted on the rear cover sheet 28 proximate to the outer edge 48 identifying a subject matter imprinted on the rear surface 158*a* of the leaf sheet 54*a* and the front surface 42 of the rear cover sheet 28. The symbol may include but not limited to numbers, letters, colors, patterns, textures or other matter.

Figure 8:
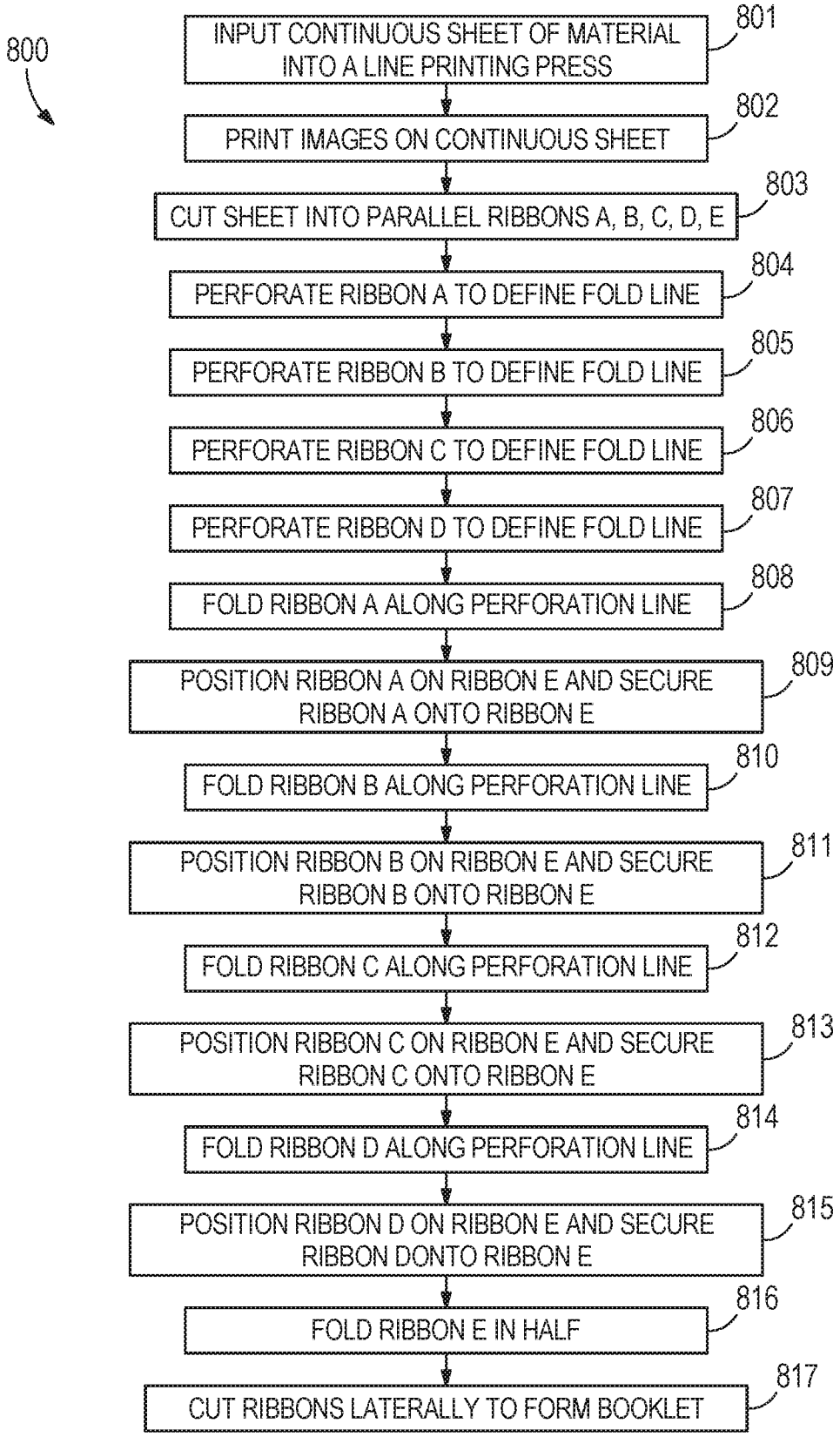
FIG. 8 depicts a flowchart showing the steps used to form the booklet of FIGS. 1-7.

FIG. 8 provides a flowchart which illustrate the method 800 utilized for manufacturing the booklet as shown in FIGS. 1-7. A continuous sheet of material is inputted into a line printing press (step 801). Images are imprinted on the continuous sheet by print units of the printing press as the continuous sheet to travels therethrough (step 802) such as that disclosed in U.S. Pat. No. 9,415,624 which disclosure is herein incorporated by reference. Thereafter, the continuous sheet travels through die cutter unit(s) of the printing press, such as that disclosed in U.S. Pat. No. 9,415,624, which causes the sheet to be split into parallel ribbons A, B, C, D, E (step 803). Ribbon A will form the leaf sheet 54*a* and spine sheet 68*a*, ribbon B will form the leaf sheet 54*b* and spine sheet 68*b*, ribbon C will form the leaf sheet 54*c* and spine sheet 68*c*, ribbon D will form the leaf sheet 54*d* and spine sheet 68*d*, and ribbon E will form the cover 22.

A linear perforation line is perforated into the ribbon A to define the hinge fold 78*a* between the leaf sheet 54*a* and the spine sheet 68*a*, and to define the leaf width W1 (step 804). A linear perforation line is perforated into the ribbon B to define the hinge fold 78*b* between the leaf sheet 54*b* and the spine sheet 68*b*, and to define the leaf width W2 (step 805). A linear perforation line is perforated into the ribbon C to define the hinge fold 78*c* between the leaf sheet 54*c* and the spine sheet 68*c*, and to define the leaf width W3 (step 806). A linear perforation line is perforated into the ribbon D to define the hinge fold 78*d* between the leaf sheet 54*d* and the spine sheet 68*d*, and to define the leaf width W4 (step 807). Each perforation can be affected by a pattern perf unit such as that disclosed in U.S. Pat. No. 9,415,624.

Ribbon A is then folded along the perforation line to form the hinge fold 78*a* (step 808) and the spine sheet 68*a* is secured directly to ribbon E in the desired location on what will become the front cover sheet 26 (step 809). Ribbon B is then folded along the perforation line to form the hinge fold 78*b* (step 810) and the spine sheet 68*a* is secured directly to ribbon E in the desired location on what will become the front cover sheet 26 and proximate to the spine sheet 68*a* (step 811). Ribbon C is then folded along the perforation line to form the hinge fold 78*c* (step 812) and the spine sheet 68*c* is secured directly to ribbon E in the desired location on what will become the front cover sheet 26 and proximate to the spine sheet 68*b* (step 813). Ribbon D is then folded along the perforation line to form the hinge fold 78*d* (step 814) and the spine sheet 68*d* is secured directly to ribbon E in the desired location on what will become the front cover sheet 26 and proximate to the spine sheet 68*b* (step 815). Ribbon E is then folded in half to form the hinge fold 24 (step 816). When ribbon E is folded to form the hinge fold 24, this positions the leaf sheets 54*a*, 54*b*, 54*c*, 54*d* between the front cover sheet 26 and the rear cover sheet 28. Each fold may be formed by a plow folding station such as that disclosed in U.S. Pat. No. 9,415,624.

Thereafter, ribbon E is cut to length (step 817) by a die cutter unit of the printing press.

While adhesive is described as the binder 82*a*, 82*b*, 82*c*, 82*d*, it is to be understood that the adhesive could be replaced by other means for joining the spine sheets 68*a*, 68*b*, 68*c*, 68*d* and front cover sheet 26 together, such as staples.

While four leaves formed of the leaf sheets 54*a*, 54*b*, 54*c*, 54*d* and integrally formed spine sheets 68*a*, 68*b*, 68*c*, 68*d* are shown and described, this first embodiment of the booklet 20 may have two leaves, may have three leaves or may have more than four leaves. Because of the structure of the booklet 20, an odd or even number of leaves may be easily provided. Each additional leaf would have a progressively smaller leaf width.

Attention is now invited to the second embodiment of the booklet 120 shown in FIGS. 9-14B. Leaf sheet 154*a* and leaf sheet 154*d* are attached to each other by an integrally formed spine sheet 180 and form a first leaf, and leaf sheet 154*b* and leaf sheet 154*c* are attached each other by an integrally formed spine sheet 182 and form a second leaf.

Spine sheet 180 has a rear surface 184, a front surface 186, an inner edge 188, an outer edge 190 and side edges extending between the inner and outer edges 188, 190. The inner and outer edges 188, 190 may be parallel to each other. The side edges may parallel to each other and may be perpendicular to the inner and outer edges 188, 190. Leaf sheet 154*a* extends from the inner edge 188 and leaf sheet

154*d* extends from the outer edge 190. Leaf sheet 154*a* and spine sheet 180 are pivotable relative to each by a hinge fold 192 which is provided at the inner edge 160*a* of the leaf sheet 154*a* and the inner edge 188 of the spine sheet 180. Leaf sheet 154*d* and spine sheet 180 are pivotable relative to each by a hinge fold 194 which is provided at the inner edge 160*d* of the leaf sheet 154*d* and the outer edge 190 of the spine sheet 180.

Spine sheet 182 has a rear surface 196, a front surface 198, an inner edge 200, an outer edge 202 and side edges extending between the inner and outer edges 200, 202. The inner and outer edges 200, 202 may be parallel to each other. The side edges may parallel to each other and may be perpendicular to the inner and outer edges 200, 202. Leaf sheet 154*b* extends from the inner edge 200 and leaf sheet 154*c* extends from the outer edge 202. Leaf sheet 154*b* and spine sheet 182 are pivotable relative to each by a hinge fold 204 which is provided at the inner edge 160*b* of the leaf sheet 154*b* and the inner edge 200 of the spine sheet 182. Leaf sheet 154*c* and spine sheet 182 are pivotable relative to each by a hinge fold 206 which is provided at the inner edge 160*c* of the leaf sheet 154*c* and the outer edge 200 of the spine sheet 182.

The second leaf formed by leaf sheets 154*b*, 154*c* and spine sheet 182 nest within the first leaf formed by leaf sheets 154*a*, 154*d* and spine sheet 180. The front surface 186 of spine sheet 180 seats against and is secured directly to the rear surface 132 of the front cover sheet 126 by a binder 208, such as an adhesive layer, and the respective leaf sheet 154*a*, 154*d* extends freely therefrom. The front surface 198 of spine sheet 182 seats against and is secured directly to the rear surface 184 of spine sheet 180 by a binder 210, such as an adhesive layer, and the respective leaf sheet 154*b*, 154*c* extends freely therefrom.

Figure 13:
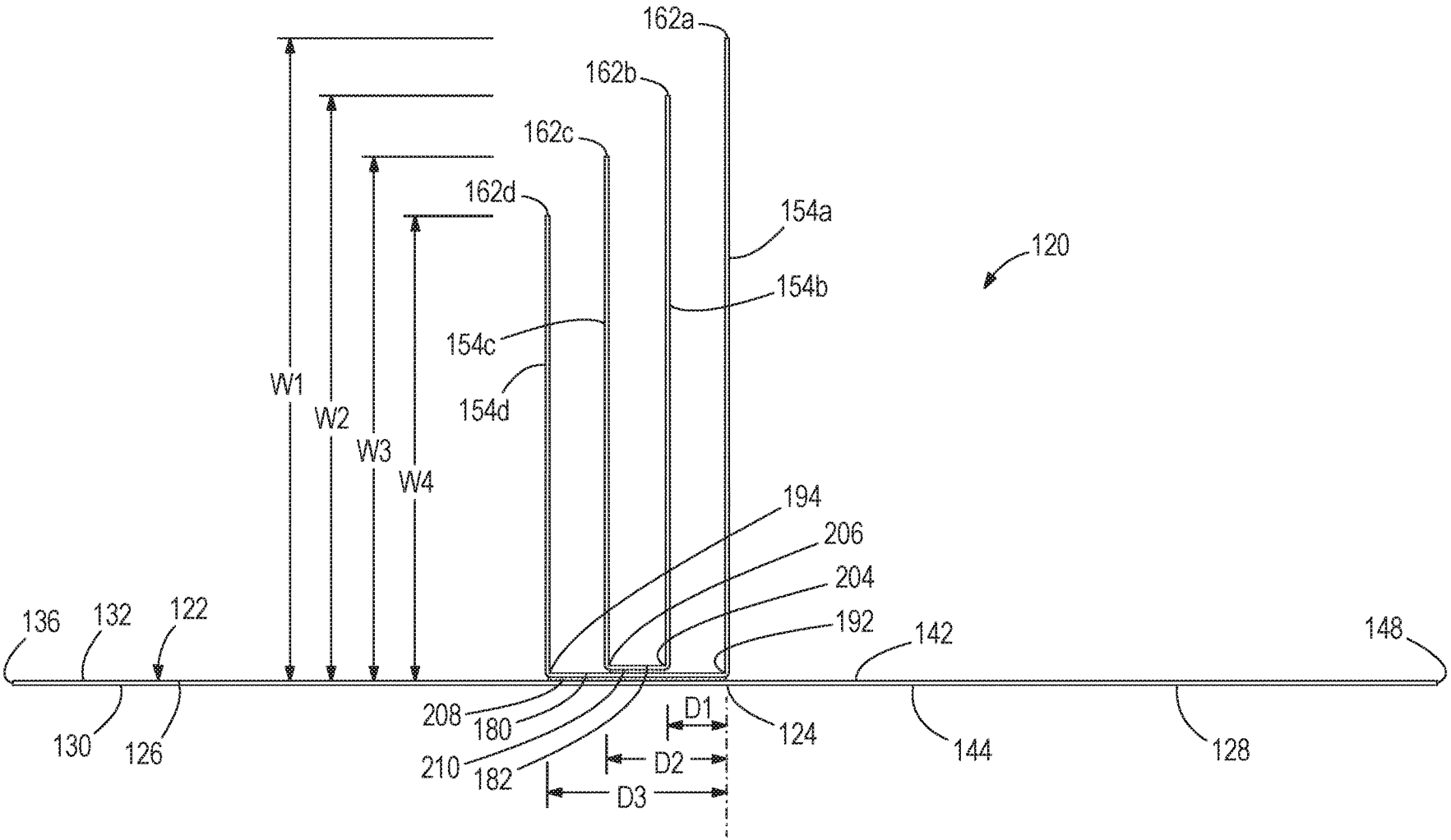
FIG. 13 depicts a side elevation view of the booklet of FIG. 9 shown open and with leaves of the booklet in an upstanding position.
Figure 14A:
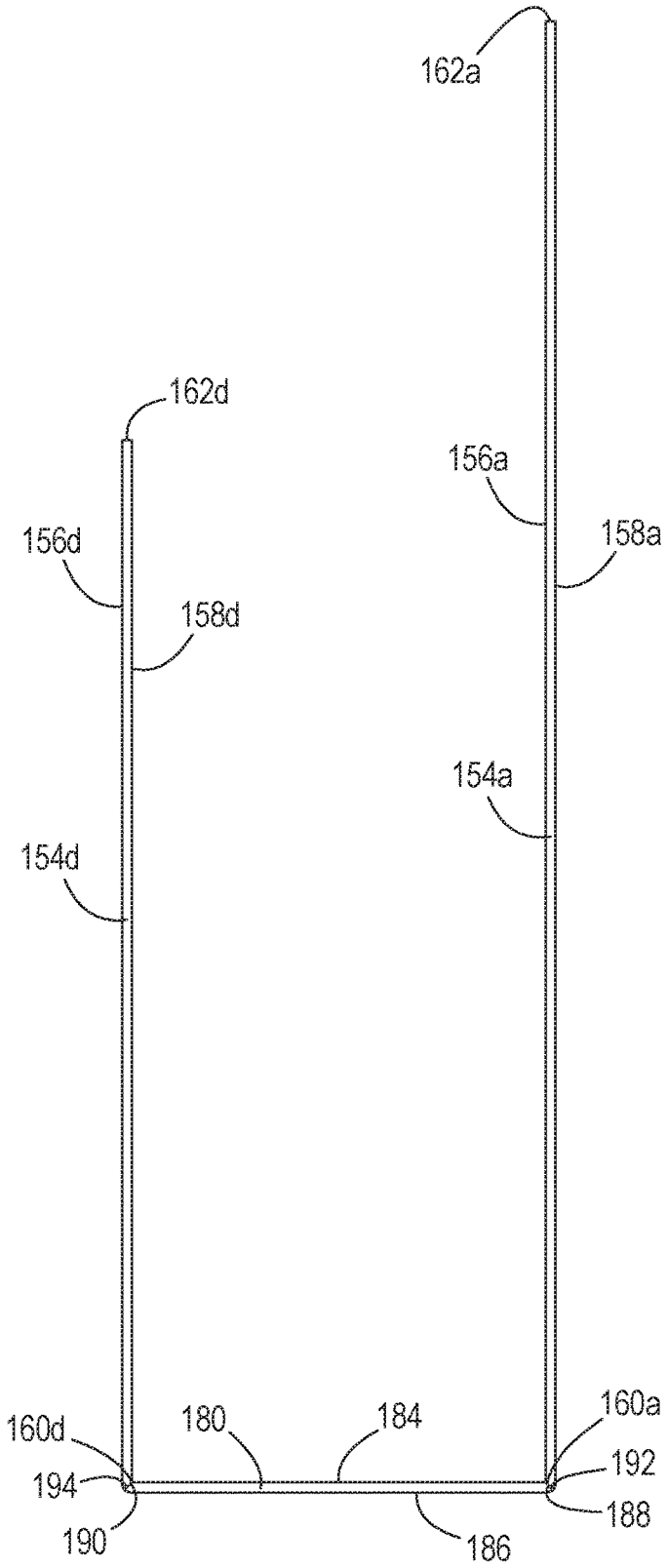
FIG. 14A depicts a side elevation view of one leaf of the booklet of FIG. 9 shown in an upstanding position.
Figure 14B:
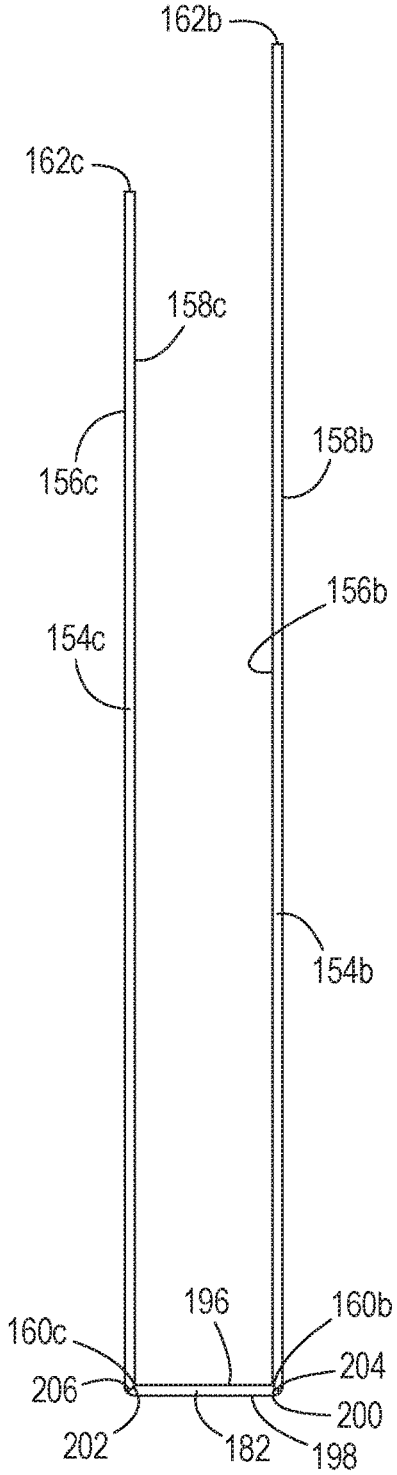
FIG. 14B depicts a side elevation view of the other leaf of the booklet of FIG. 9 shown in an upstanding position.

As shown in FIG. 13, when the first leaf formed by leaf sheets 154*a*, 154*d* and spine sheet 180 is shown in an upstanding position, the first leaf is generally U-shaped; and when the second leaf formed by leaf sheets 154*b*, 154*c* and spine sheet 182 is shown in an upstanding position, the second leaf is generally U-shaped.

The distance between the hinge fold 124 and the hinge fold 204 defines a leaf offset dimension D1; the distance between the hinge fold 124 and the hinge fold 206 defines a leaf offset dimension D2; the distance between the hinge fold 124 and the hinge fold 194 defines a leaf offset dimension D3. The leaf offset dimension D1 is less than the leaf offset dimension D2. The leaf offset dimension D2 is less than the offset dimension D3. In an embodiment, the leaf offset dimension D2 is two times the leaf offset dimension D1, and the leaf offset dimension D3 is three times the leaf offset dimension D1.

In some embodiments and as shown, the difference between leaf offset dimension D2 and leaf offset dimension D3, and the difference between leaf offset dimension D3 and leaf offset dimension D4 are the same such that the leaf sheets 154*a*, 154*b*, 154*c*, 154*d* are equally spaced from each other. In some embodiments, the differences between the leaf offset dimensions are not the same such that the leaf sheets 154*a*, 154*b*, 154*c*, 154*d* are not equally spaced from each other. Spine sheet 180 has length defined between the edges 188, 190 which is greater than the length of the spine sheet 182 which is defined between the edges 200, 202. As shown, the hinge fold 192 aligns with the hinge fold 124 of the cover 122, however, the hinge fold 192 may be offset from the hinge fold 124 to define a leaf offset dimension (not shown).

The leaf offset dimension D1 and the leaf width W2 causes the second leaf sheet 154*b* to be displaced relative to the first leaf sheet 154*a* and the rear cover sheet 128 and create a step display tab area 212 on the front surface 156*a* of the first leaf sheet 154*a* that is progressively revealed adjacent to the outer edge 62*b* of the second leaf sheet 154*b* during pivoting the front cover sheet 126 between the closed position and the open position. A symbol may be imprinted on the step display tab area 212 identifying a subject matter imprinted on the front surface 156*a* of the first leaf sheet 154*a* and the rear surface 158*b* of the second leaf sheet 154*b*. The symbol may include but not limited to numbers, letters, colors, patterns, textures or other matter.

The leaf offset dimension D2 and the leaf width W3 causes the third leaf sheet 154*c* to be displaced relative to the second leaf sheet 154*b* and create a step display tab area 214 on the front surface 156*b* of the second leaf sheet 154*b* that is progressively revealed adjacent to the outer edge 62*c* of the third leaf sheet 154*c* during pivoting the front cover sheet 126 between the closed position and the open position. A symbol may be imprinted on the step display tab area 214 identifying a subject matter imprinted on the front surface 156*b* of the second leaf sheet 154*b* and the rear surface 158*c* of the second leaf sheet 154*c*. The symbol may include but not limited to numbers, letters, colors, patterns, textures or other matter.

The leaf offset dimension D3 and the leaf width W4 causes the fourth leaf sheet 154*d* to be displaced relative to the third leaf sheet 154*c* and create a step display tab area 216 on the front surface 156*c* of the third leaf sheet 154*c* that is progressively revealed adjacent to the outer edge 62*d* of the fourth leaf sheet 154*d* during pivoting the front cover sheet 126 between the closed position and the open position. A symbol may be imprinted on the step display tab area 216 identifying a subject matter imprinted on the front surface 156*a* of the third leaf sheet 154*c* and the rear surface 158*d* of the fourth leaf sheet 154*d*. The symbol may include but not limited to numbers, letters, colors, patterns, textures or other matter.

In an embodiment, when the front cover sheet 126 is in the closed position, the outer edges 162*a*, 162*b*, 162*c*, 162*d* align with each other and are spaced from the outer edges 136, 148 of the front and rear cover sheets 126, 128.

Figure 15:
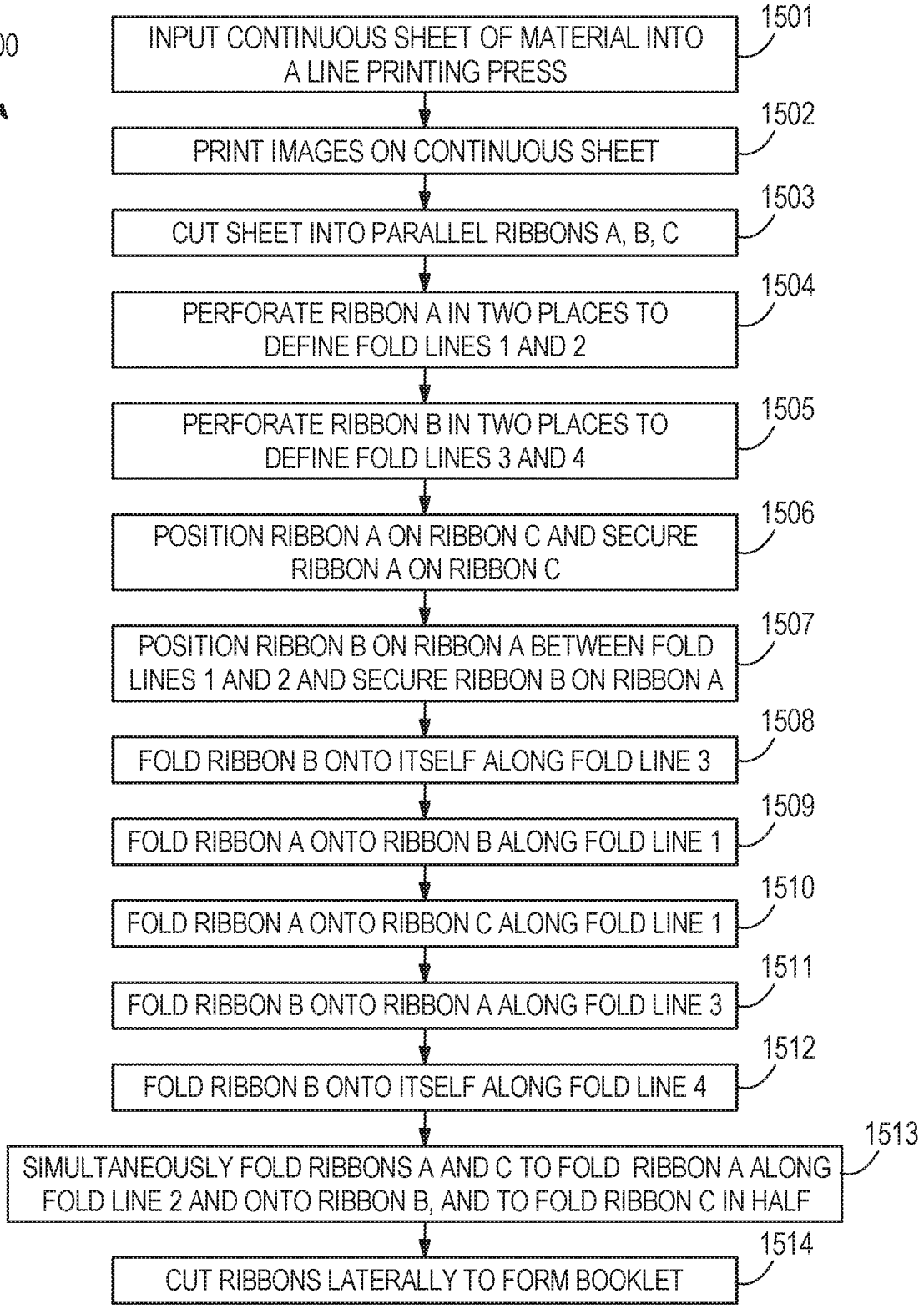
FIG. 15 depicts a flowchart showing the steps used to form the booklet of FIGS. 9-14B.

FIG. 15 provides a flowchart which illustrate the method 1500 utilized for manufacturing the booklet as shown in FIGS. 9-14B. A continuous sheet of material is inputted into a line printing press (step 1501). Images are imprinted on the continuous sheet by print units of the printing press as the continuous sheet to travels therethrough (step 1502) such as that disclosed in U.S. Pat. No. 9,415,624. Thereafter, the continuous sheet travels through die cutter unit(s) of the printing press, such as that disclosed in U.S. Pat. No. 9,415,624, which causes the sheet to be split into parallel ribbons A, B, C (step 1503). Ribbon A will form the first leaf sheet 154*a*, spine sheet 180 and fourth leaf sheet 154*d*, ribbon B will form the second leaf sheet 154*b*, spine sheet 182 and third leaf sheet 154*c*, and ribbon C will form the cover 122.

A pair of spaced apart linear perforation lines are perforated into the ribbon A to form linear perforation lines and to define the hinge fold 192 (fold line 2) between the leaf sheet 154*a* and the spine sheet 180, the leaf width W1, the hinge fold 194 (fold line 1) between the leaf sheet 154*d* and the spine sheet 180, and the leaf width W4 (step 1504). A pair of spaced apart linear perforations are perforated into the ribbon B to form linear perforation lines and to define the hinge fold 204 (fold line 4) between the leaf sheet 154*b* and the spine sheet 182, the leaf width W2, the hinge fold 206 (fold line 3) between the leaf sheet 154*c* and the spine sheet 182, and the leaf width W3 (step 1505). Each perforation can be affected by a pattern perf unit such as that disclosed in U.S. Pat. No. 9,415,624.

Ribbon A is then positioned onto ribbon C and ribbon A is secured directly to ribbon C (step 1506). Ribbon B is then positioned onto ribbon A and ribbon B is secured directly to ribbon A (step 1507). In step 1507, ribbon B is positioned between the fold lines 1 and 2 of ribbon A. Next, ribbon B is folded onto itself along fold line 3 (step 1508); fold line 3 becomes hinge fold 206. Ribbon A is then folded onto ribbon B along fold line 1 (step 1509); fold line 1 becomes hinge fold 194. Thereafter, ribbon A is again folded along fold line 1 (step 1510) and onto ribbon C. As such, the hinge fold 194 has been manipulated twice in the manufacturing process which causes fatigue in the hinge fold 194. Next, ribbon B is again folded along fold line 3 (step 1511) and onto ribbon A. As such, the hinge fold 206 has been manipulated twice in the manufacturing process which causes fatigue in the hinge fold 206. Ribbon B is folded onto itself along fold line 4 (step 1512); fold line 4 becomes hinge fold 204. Next, ribbons A and C are simultaneously folded such that ribbon A is folded along fold line 2 which becomes fold line 192 and ribbon C is folded in half along a fold line which becomes the hinge fold 124. Each fold may be formed by a plow folding station such as that disclosed in U.S. Pat. No. 9,415,624.

Thereafter, the ribbons A, B, C are cut to length (step 1514) by a die cutter unit of the printing press.

As discussed above, hinge folds 194. 206 are manipulated twice in the manufacturing process which causes fatigue in the hinge folds 194, 206. This is beneficial in the final booklet 120 because this causes the leaves formed by leaf sheets 154*c*, 154*d* to better lay flat.

While two leaves formed of the leaf sheets 154*a*, 154*d* and integrally formed spine sheet 180 and leaf sheets 154*b*, 154*c* and integrally formed spine sheet 182 are shown and described, this second embodiment of the booklet 120 may have more than two leaves which are nested within each other.

While adhesive is described as the binder 208, 210, it is to be understood that the adhesive could be replaced by other means for joining the spine sheets 180, 182 and front cover sheet 26 together, such as staples.

FIG. 16 shows a modification to the booklet 120 which includes a leaf 218 formed of a leaf sheet and integrally formed spine identical to those provided in the first embodiment of the booklet 20 nested within the second leaf formed by leaf sheets 154*b*, 154*c* and spine sheet 182 and secured directly to the rear surface 196 of the second leaf by a binder 220, such as an adhesive layer. While adhesive is described as the binder 220, it is to be understood that the adhesive could be replaced by other means for joining the spine sheet of the leaf 218 and front cover sheet 126 together, such as staples. The leaf sheet of the leaf 218 has a leaf width W5 which is less than the leaf width W2, and the leaf 218 defines a leaf offset dimension D4 which is greater than the leaf offset dimension D1 and less than leaf offset dimension D2. This provides for an odd number of leaf sheets to be provided.

FIG. 17 shows yet another modification to the booklet 120 which includes leaf 218 formed of a leaf sheet and integrally formed spine identical to those provided in the first embodiment of the booklet 20. As shown, the leaf 218 is positioned proximate to the leaf sheet 154*d* and is secured directly to the rear surface 132 of the front cover sheet 126 by a binder 220, such as an adhesive layer. While adhesive is described as the binder 220, it is to be understood that the adhesive could be replaced by other means for joining the spine sheet of the leaf 218 and front cover sheet 126 together, such as staples. The leaf sheet of the leaf 218 has a leaf width W5 which is less than the leaf width W4, and the leaf 218 defines a leaf offset dimension D4 which is greater than the leaf offset dimension D3. Alternatively, the leaf 218 can be positioned proximate to the hinge fold 124 with the first and second nested leaves being outwardly therefrom. This provides for an odd number of leaf sheets to be provided.

While the terms "align", "aligned", "aligns" are used herein, it is to be understood that the components may not completely align with each other, such that they substantially align to account for a margin of error in the manufacturing process of the booklets 20, 120.

While particular embodiments are illustrated in and described with respect to the drawings, it is envisioned that those skilled in the art may devise various modifications without departing from the spirit and scope of the appended claims. It will therefore be appreciated that the scope of the disclosure and the appended claims is not limited to the specific embodiments illustrated in and discussed with respect to the drawings and that modifications and other embodiments are intended to be included within the scope of the disclosure and appended drawings. Moreover, although the foregoing descriptions and the associated drawings describe example embodiments in the context of certain example combinations of elements and/or functions, it should be appreciated that different combinations of elements and/or functions may be provided by alternative embodiments without departing from the scope of the disclosure and the appended claims.

What is claimed is:

1. A booklet comprising:

a cover including a front cover sheet and a rear cover sheet connected by a hinge fold around which the front cover sheet is pivoted relative to the rear cover between a closed position and an open position; and first and second leaves, each leaf comprised of an integrally formed first leaf sheet, spine sheet and second leaf sheet, the first leaf sheet and the spine sheet connected together at a first hinge fold, the second leaf sheet and the spine sheet connected together at a second hinge fold, wherein the spine sheet of the first leaf having a front surface secured directly to a rear surface of the front cover sheet with the first hinge fold of the first leaf proximate to the hinge fold of the cover, and the spine sheet of the second leaf having a front surface secured directly to a rear surface of the spine sheet of the first leaf with the first hinge fold of the second leaf proximate to the first hinge fold of the first leaf, and wherein a first leaf offset dimension is defined between the hinge fold of the cover and the first hinge fold of the second leaf, a second leaf offset dimension is defined between the hinge fold of the cover and the second hinge fold of the second leaf, and a third leaf offset dimension is defined between the hinge fold of the cover and the second hinge fold of the first leaf, the first leaf offset dimension being less than the second offset dimension, the second leaf offset dimension being less than the third leaf offset dimension.

2. The booklet of claim 1, wherein a first leaf width is defined between the first hinge fold of the first leaf and a free end of the first leaf sheet of the first leaf, a second leaf width is defined between the first hinge fold of the second leaf and a free end of the first leaf sheet of the second leaf, a third leaf width is defined between the second hinge fold of the second leaf and a free end of the second leaf sheet of the second leaf, and a fourth leaf width is defined between the second hinge fold of the first leaf and a free end of the second leaf sheet of the first leaf, the first leaf width being greater than the second leaf width, the second leaf width being greater than the third leaf width, and the third leaf width being greater than the fourth leaf width.

3. The booklet of claim 2, wherein a first difference is defined between the first leaf width and the second leaf width, a second difference is defined between second leaf width and the third leaf width, and a third difference is defined between the third leaf width and the fourth leaf width, wherein each difference is the same.

4. The booklet of claim 1, wherein the first hinge fold of the first leaf aligns with the hinge fold of the cover.

5. The booklet of claim 4, wherein the hinge fold of each leaf comprises a linear perforation.

6. The booklet of claim 1, wherein the spine sheet of the first leaf is adhesively bonded to the rear surface of the front cover sheet, and the spine sheet of the second leaf is adhesively bonded to the rear surface of the spine sheet of the first leaf.

7. The booklet of claim 1, wherein the hinge fold of each leaf comprises a linear perforation.

8. The booklet of claim 1, wherein each leaf has at least one image printed thereon.

9. The booklet of claim 1, wherein the cover and each leaf is formed of one of a cellulose pulp material, a paper material, and a polymeric material.

10. The booklet of claim 1, wherein each leaf sheet has a free end, the front cover sheet has a free end and the rear cover sheet has a free ends, and the free ends of the leaf sheets align with each other and do not align with the free ends of the front and rear cover sheets when the cover is in the closed position.

11. The booklet of claim 1, wherein the second leaf offset dimension is two times the first leaf offset dimension, and the third leaf offset dimension is three times the first leaf offset dimension.

12. The booklet of claim 1, wherein the leaf sheets are equally spaced from each other.

13. The booklet of claim 1, further comprising a third leaf including a leaf sheet and an integrally formed spine sheet, the third leaf being nested within the second leaf, the spine sheet of the third leaf being secured directly to a rear surface of the spine sheet of the second leaf.

14. The booklet of claim 1, further comprising a third leaf including a leaf sheet and an integrally formed spine sheet, the third leaf being proximate to one of the first leaf sheet of the first leaf and the second leaf sheet of the first leaf and being secured directly to the rear surface of the front cover sheet.

15. A method of forming a booklet comprising:

positioning a first ribbon on a third ribbon and directly securing a rear surface of the first ribbon to a front surface of the third ribbon;

positioning a second ribbon on the first ribbon and directly securing a rear surface of the second ribbon to a front surface of the first ribbon;

folding the second ribbon along a first fold line of the second ribbon in a first direction;

folding the first ribbon along a first fold line of the first ribbon in a first direction;

folding the first ribbon along the first fold line of the first ribbon in a second direction which is opposite to the first direction in which the first ribbon was folded;

folding the second ribbon along the first fold line of the second ribbon in a second direction which is opposite to the first direction in which the second ribbon was folded;

folding the second ribbon along a second fold line of the second ribbon in a first direction; and simultaneously folding the third ribbon and the first ribbon.

16. The method of claim 15, wherein prior to positioning the first ribbon on the third ribbon, further comprising:

perforating the first ribbon to form a first linear perforation line and a second linear perforation line; and perforating the second ribbon to form a first linear perforation line in the second ribbon and a second linear perforation line in the second ribbon, wherein the first ribbon is folded along each perforation line therein, and the second ribbon is folded along each perforation line therein.

17. The method of claim 15, wherein after simultaneously folding the third ribbon and the first ribbon, further comprising cutting the ribbons laterally.

18. The method of claim 15, wherein prior to positioning the first ribbon on the third ribbon, further comprising inputting a continuous sheet of material into a line printing press;

printing images on the continuous sheet; and cutting the sheet into the first, second and third ribbons.

19. The method of claim 15, wherein when the third ribbon and the first ribbon are simultaneously folded, the third ribbon is folded in half.

20. The method of claim 15, wherein prior to positioning the first ribbon on the third ribbon, further comprising printing images on first, second and third ribbons.

21. The method of claim 15, wherein the first ribbon is secured to the third ribbon by adhesive, and the second ribbon is secured to the first ribbon by adhesive.

22. A method of forming a booklet comprising:

perforating a first ribbon to form a first linear perforation line and a second linear perforation line;

perforating a second ribbon to form a first linear perforation line in the second ribbon and a second linear perforation line in the second ribbon;

positioning the first ribbon on a third ribbon and securing the first ribbon on the third ribbon;

positioning the second ribbon on the first ribbon and securing the second ribbon on the first ribbon;

folding the second ribbon along the first linear perforation line thereof to form a first fold line of the second ribbon in a first direction;

folding the first ribbon along the first linear perforation line thereof to form a first fold line of the first ribbon in a first direction;

folding the first ribbon along the first fold line of the first ribbon in a second direction which is opposite to the first direction in which the first ribbon was folded;

folding the second ribbon along the first fold line of the second ribbon in a second direction which is opposite to the first direction in which the second ribbon was folded;

folding the second ribbon along the second linear perforation line thereof to form a second fold line of the second ribbon in a first direction; and simultaneously folding the third ribbon and the first ribbon along the second linear perforation line of the first ribbon.

23. The method of claim 22, wherein prior to positioning the first ribbon on the third ribbon, further comprising inputting a continuous sheet of material into a line printing press; printing images on the continuous sheet; and cutting the sheet into the first, second and third ribbons.

* * * * *